US011446203B2

(12) United States Patent
Topolovac et al.

(10) Patent No.: US 11,446,203 B2
(45) Date of Patent: Sep. 20, 2022

(54) SEXUAL STIMULATION SYSTEMS AND METHODS OF USE

(71) Applicant: Crave Innovations, Inc., San Francisco, CA (US)

(72) Inventors: Michael Topolovac, San Francisco, CA (US); Tian Yi Chang, San Francisco, CA (US); Calvin Fung, San Francisco, CA (US); Tad Masek, San Francisco, CA (US); Christine Concho, San Francisco, CA (US)

(73) Assignee: Crave Innovations, Inc., San Francisco, CA (US)

( * ) Notice: Subject to any disclaimer, the term of this patent is extended or adjusted under 35 U.S.C. 154(b) by 215 days.

(21) Appl. No.: 16/912,317

(22) Filed: Jun. 25, 2020

(65) Prior Publication Data

US 2020/0405573 A1 Dec. 31, 2020

Related U.S. Application Data

(60) Provisional application No. 62/867,090, filed on Jun. 26, 2019.

(51) Int. Cl.
*A61H 19/00* (2006.01)

(52) U.S. Cl.
CPC ..... *A61H 19/44* (2013.01); *A61H 19/32* (2013.01); *A61H 19/34* (2013.01); *A61H 2201/0107* (2013.01); *A61H 2201/165* (2013.01); *A61H 2201/5084* (2013.01)

(58) Field of Classification Search
CPC ..... A61H 2201/16; A61H 2201/165; A61H 2201/0107; A61H 2205/04; A61H 2205/067; A61H 2205/087; A61H 19/00; A61H 19/30; A61H 19/32; A61H 19/34; A61H 19/40; A61H 19/44; A61H 19/50; A61H 2023/263
See application file for complete search history.

(56) References Cited

U.S. PATENT DOCUMENTS

| | | | | |
|---|---|---|---|---|
| 6,382,815 | B1 * | 5/2002 | Klearman | A61H 23/0263 362/253 |
| 6,490,885 | B1 * | 12/2002 | Wilkinson | A61H 23/0263 362/253 |
| 7,438,681 | B2 | 10/2008 | Kobashikawa et al. | |
| 8,174,371 | B2 | 5/2012 | Schwieger | |
| 8,821,421 | B2 | 9/2014 | Imboden et al. | |
| 9,383,175 | B2 | 7/2016 | Walter et al. | |
| 2003/0181784 | A1 * | 9/2003 | Klein | A61H 19/34 600/38 |

(Continued)

*Primary Examiner* — Samuel G Gilbert
(74) *Attorney, Agent, or Firm* — Jeffrey Schox; Diana Lin

(57) ABSTRACT

A sexual stimulation system, preferably including one or more excitation devices and one or more accessories. An excitation device, preferably including one or more housings, and optionally including one or more stimulation units, power modules, sensors, user input elements, communication modules, processors and/or control modules. An accessory, preferably including one or more mating elements, and optionally including one or more user interface elements. A method of use, preferably including configuring the system in a mated configuration, configuring the system in an unmated configuration, and/or providing stimulation using the system.

19 Claims, 25 Drawing Sheets

(56) References Cited

U.S. PATENT DOCUMENTS

| | | | |
|---|---|---|---|
| 2004/0082831 | A1 | 4/2004 | Kobashikawa et al. |
| 2009/0318753 | A1 | 12/2009 | Metri |
| 2010/0013610 | A1 | 1/2010 | Schwieger |
| 2011/0124959 | A1 | 5/2011 | Murison |

* cited by examiner

SEXUAL STIMULATION SYSTEMS AND METHODS OF USE

CROSS-REFERENCE TO RELATED APPLICATIONS

This application claims the benefit of U.S. Provisional Application Ser. No. 62/867,090, filed on 26 Jun. 2019, which is incorporated in its entirety by this reference.

TECHNICAL FIELD

This invention relates generally to the sexual stimulation field, and more specifically to new and useful sexual stimulation systems and/or methods of use.

BACKGROUND

Some sexual stimulation systems are configured to be worn by a user, such as systems configured to be worn on a user's finger. However, such systems may include only a fixed mechanism for coupling to the user. Thus, there is a need in the sexual stimulation field to create new and useful sexual stimulation systems and methods of use.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview.

Figure 1A:
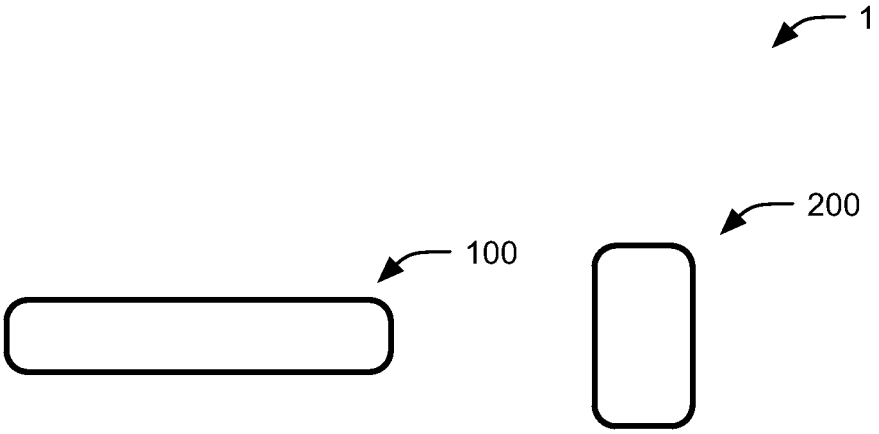
FIGS. 1A-1B are schematic representations of an embodiment of the system, in an unmated and mated configuration, respectively.
Figure 1B:
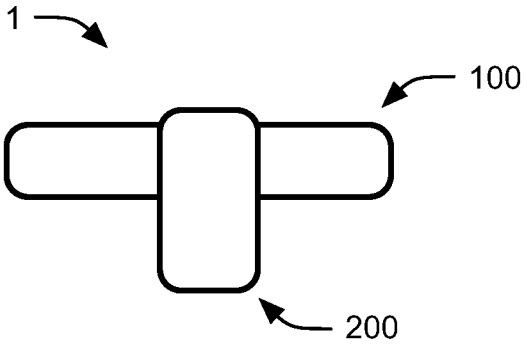

A sexual stimulation system 1 preferably includes one or more excitation devices 100 and one or more accessories 200 (e.g., as shown in FIGS. 1A-1B). The system (e.g., the excitation device 100) preferably functions as a sex toy, and can be used, for example, to stimulate one or more erogenous zones and/or other body parts of a user or users. The system (e.g., the accessory 200) can additionally or alternatively function as a wearable and/or decorative item (e.g., jewelry), which can be worn, for example, while the system is and/or is not in use as a sex toy.

The system 1 is preferably configurable between an unmated configuration, in which the excitation device and accessory are separate, and a mated configuration, in which the excitation device and accessory are mechanically connected (e.g., operable to be configured in the unmated configuration and/or the mated configuration, and operable to transition between the mated and unmated configurations), such as shown by way of example in FIGS. 1A-1B. In the mated configuration, the excitation device and accessory are preferably in a substantially fixed coupling and/or restricted to only a minimal amount and/or kind of relative motion (e.g., wherein vibration of the excitation device preferably does not cause a buzz and/or rattle at the coupling between the excitation device and the accessory). The system can optionally include multiple excitation devices and/or accessories (e.g., interchangeable excitation devices and/or accessories, such as wherein any excitation device can mate with any accessory).

However, the system can additionally or alternatively include any other suitable elements in any suitable arrangement.

Figure 2:
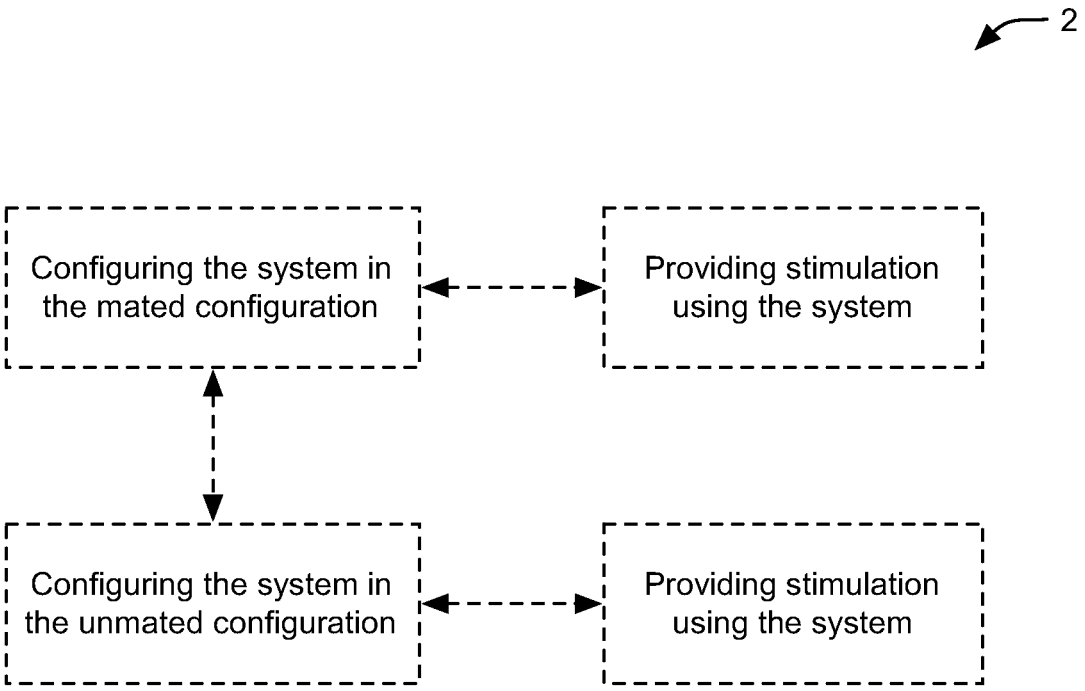
FIG. 2 is a schematic representation of an embodiment of the method.

A method 2 is preferably performed using the system, but can additionally or alternatively be performed using any other suitable system. The method 2 can include one or more of: configuring the system in the mated configuration (e.g., mating the excitation device to the accessory), configuring the system in the unmated configuration (e.g., unmating the excitation device from the accessory), and/or providing stimulation using the system, such as shown in FIG. 2. However, the method 2 can additionally or alternatively include any other suitable elements performed in any suitable manner.

2. System.

2.1 Excitation Device.

Figure 10A:
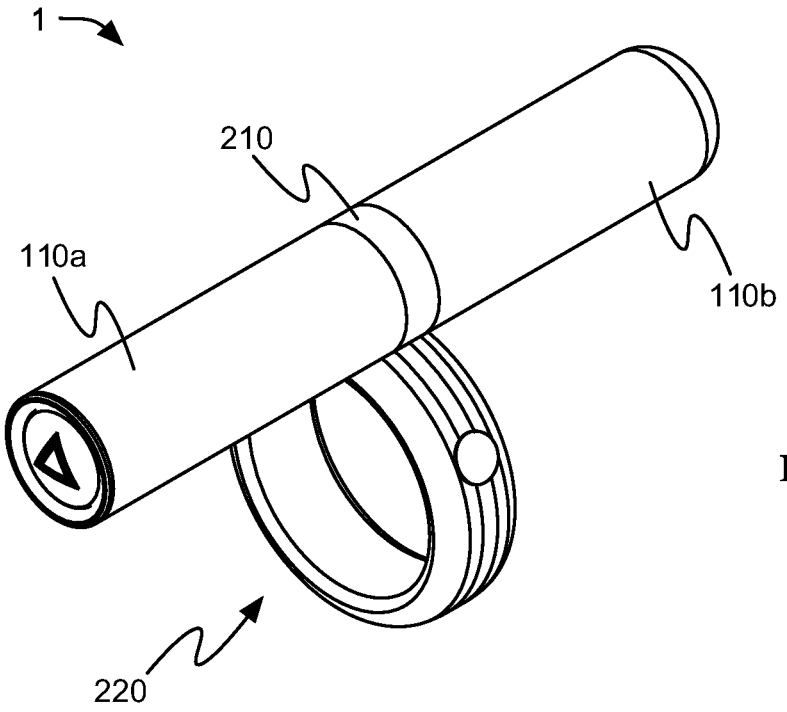
FIGS. 10A-10B are isometric views of a second specific example of the system, in a mated and unmated configuration, respectively.
Figure 10B:
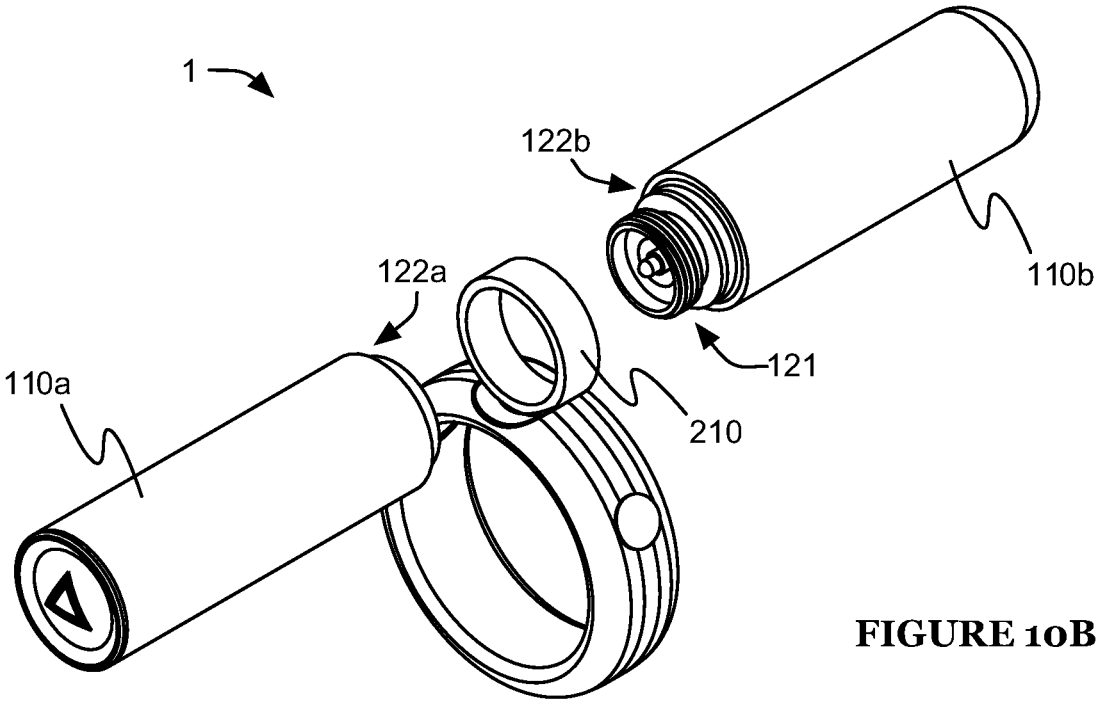
Figure 10C:
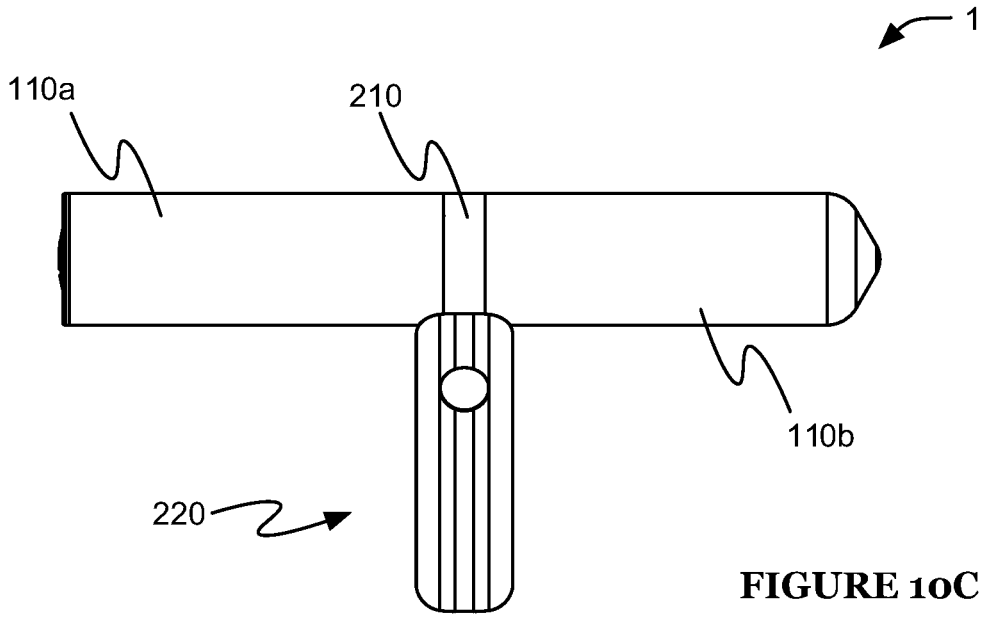
FIGS. 10C-10D are side views of the second specific example of the system, in the mated and unmated configuration, respectively.
Figure 10D:
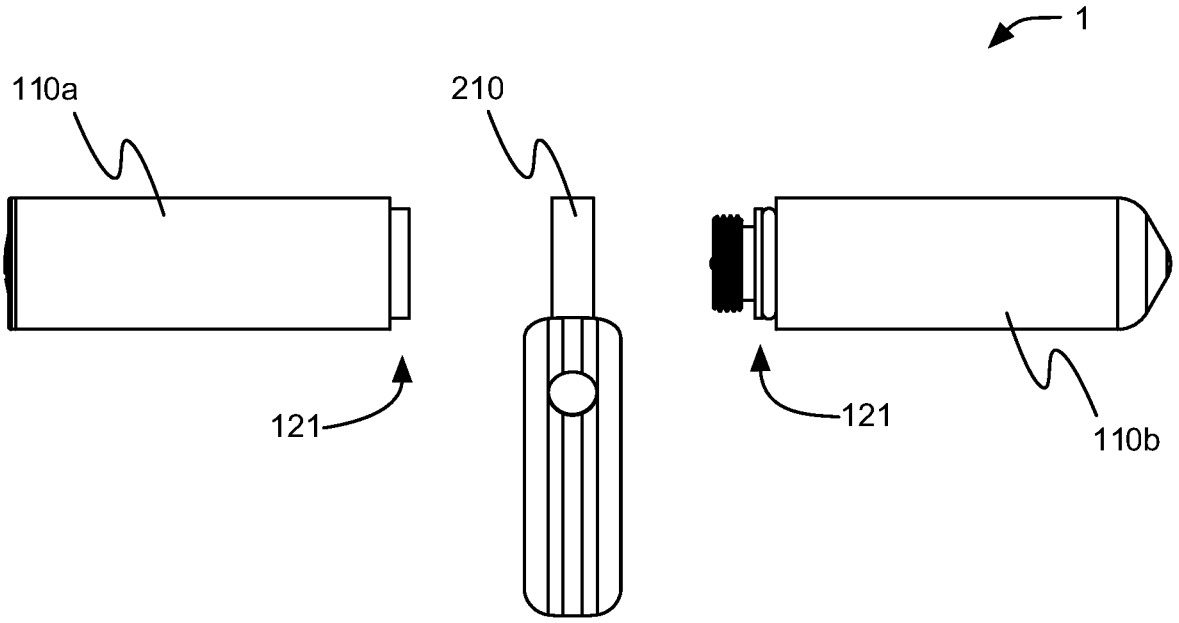
Figure 10E:
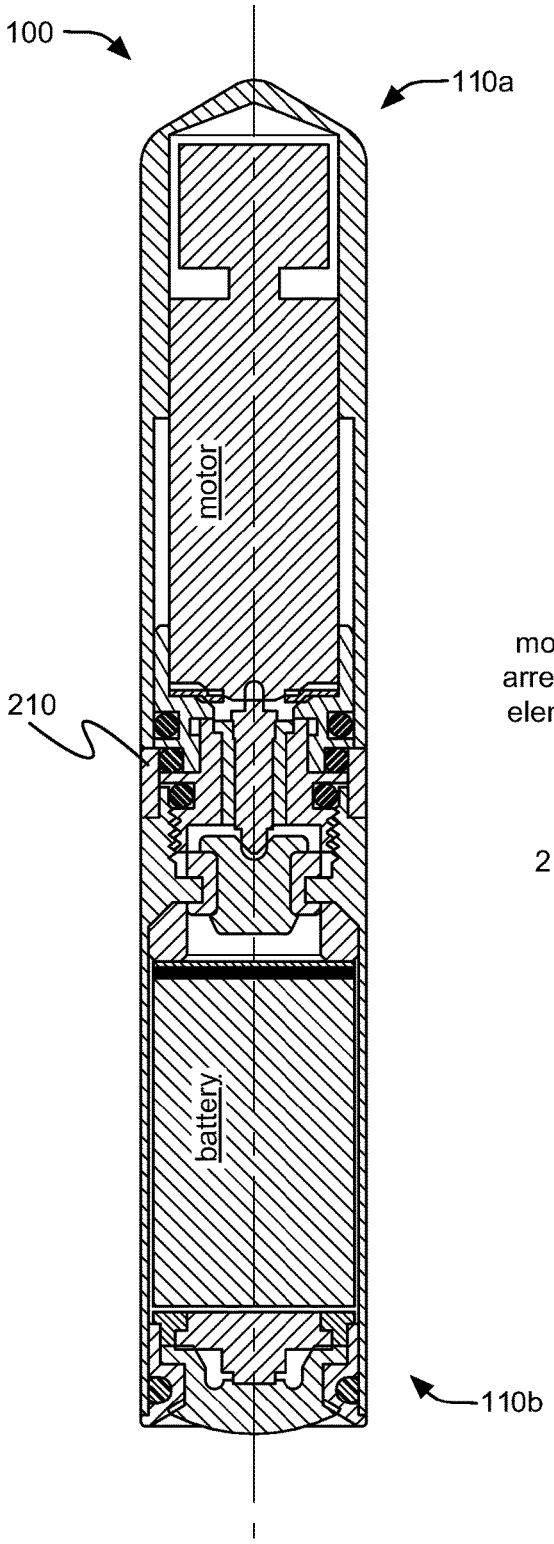
FIG. 10E is a cross-sectional view of the second specific example of the system, in the mated configuration.
Figure 10F:
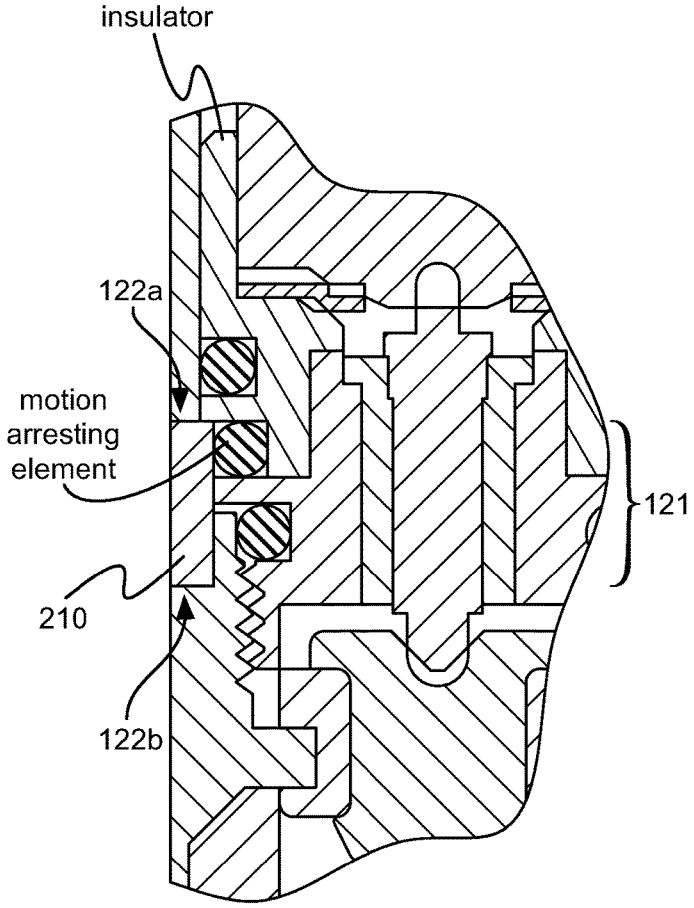
FIG. 10F is a detail view of a portion of FIG. 10E.
Figure 11A:
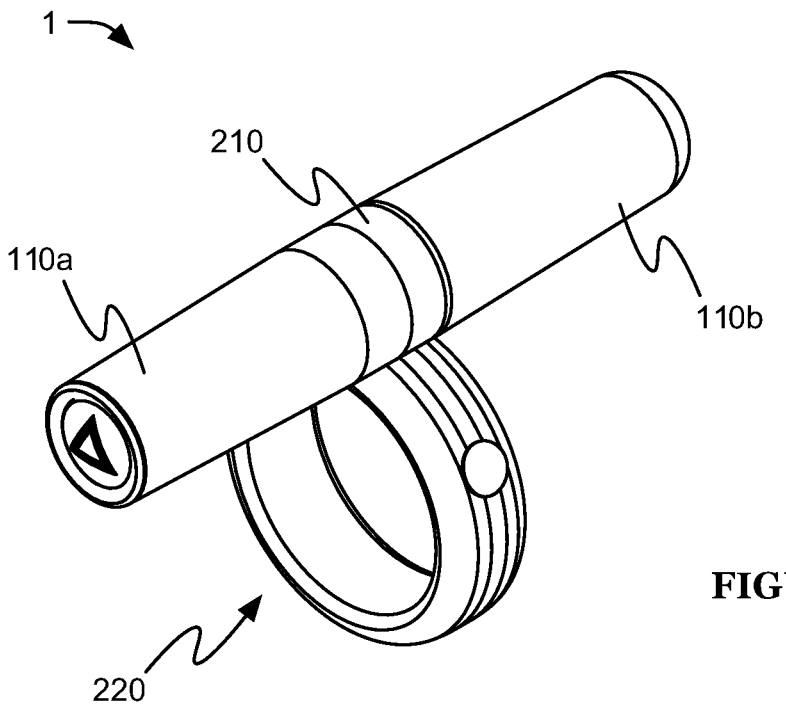
FIGS. 11A-11B are isometric views of a third specific example of the system, in a mated and unmated configuration, respectively.
Figure 11B:
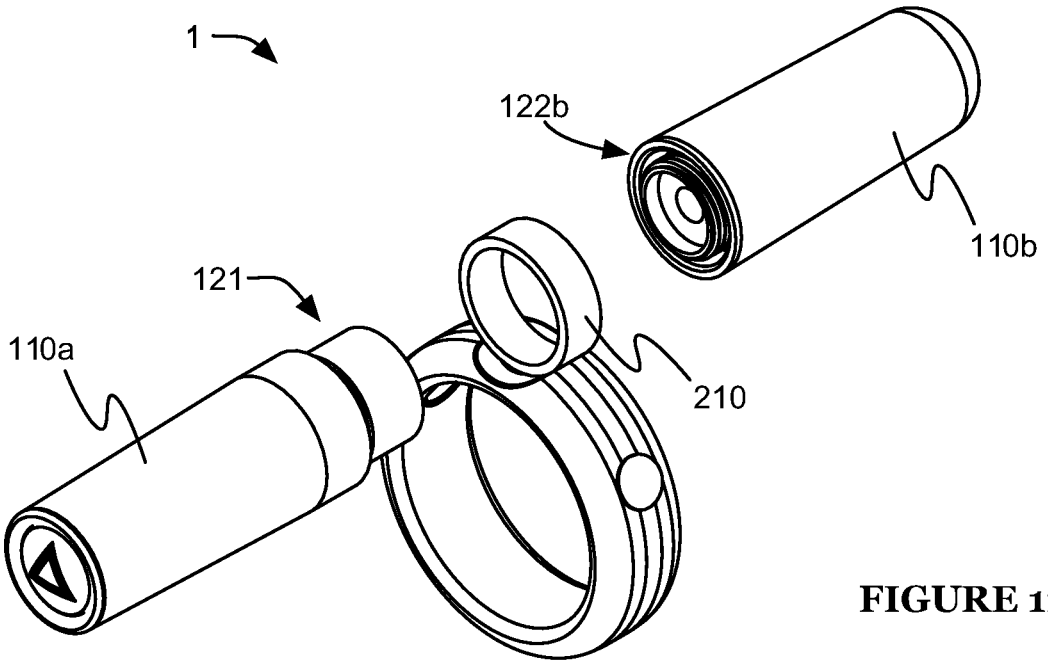
Figure 11C:
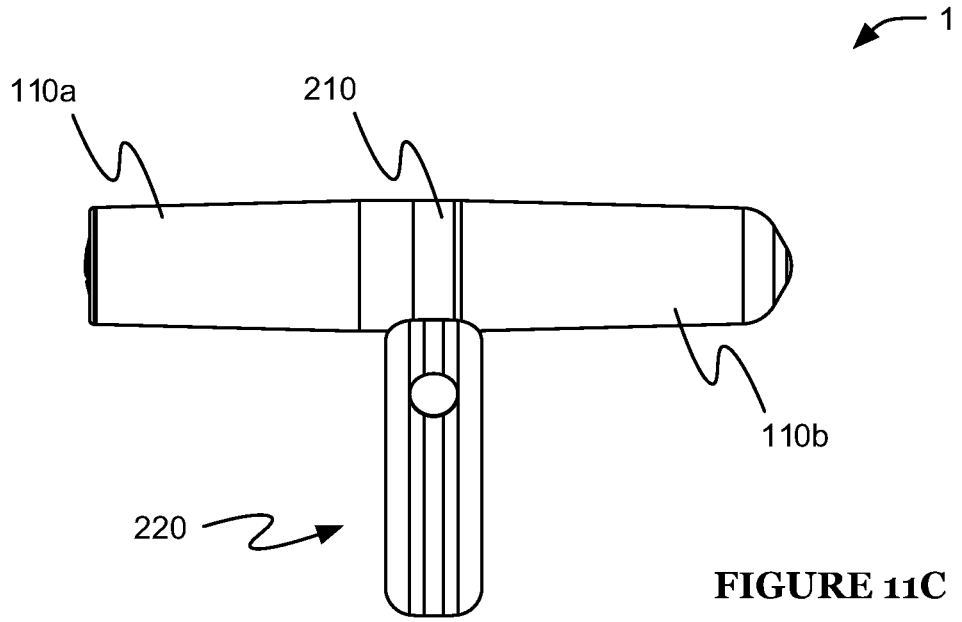
FIGS. 11C-11D are side views of the third specific example of the system, in the mated and unmated configuration, respectively.
Figure 11D:
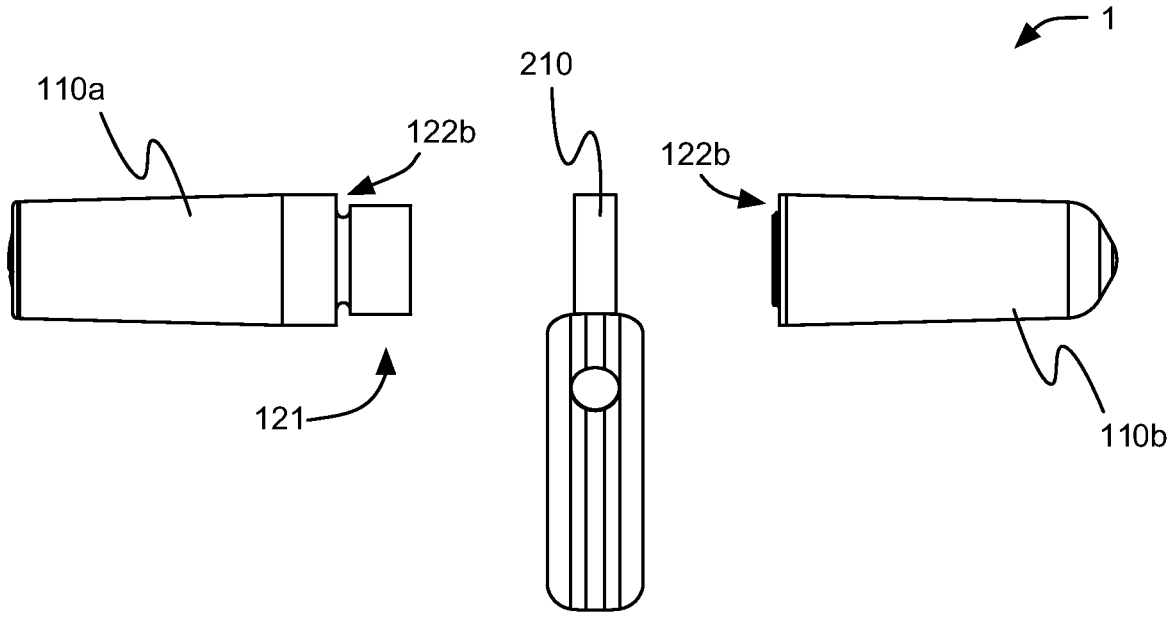
Figure 11E:
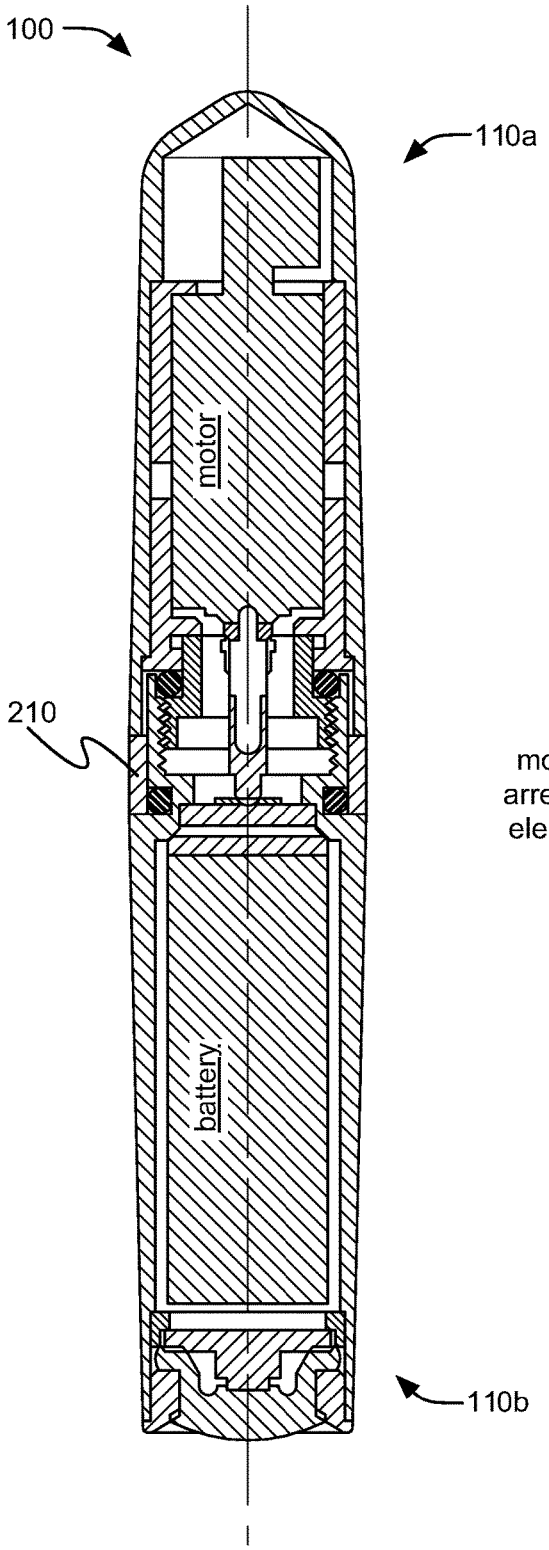
FIG. 11E is a cross-sectional view of the third specific example of the system, in the mated configuration.
Figure 11F:
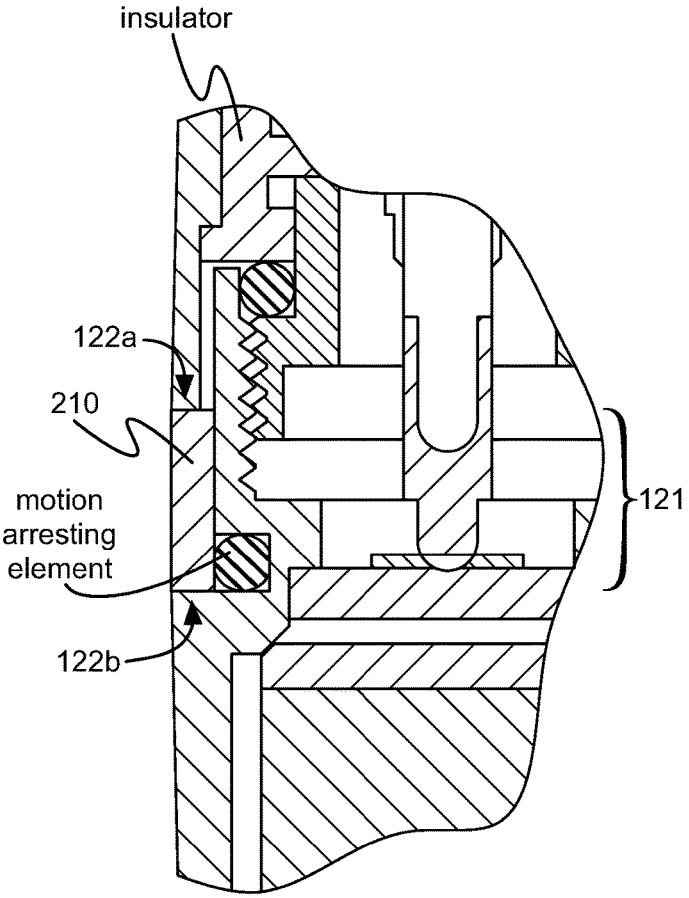
FIG. 11F is a detail view of a portion of FIG. 11E.
Figure 12A:
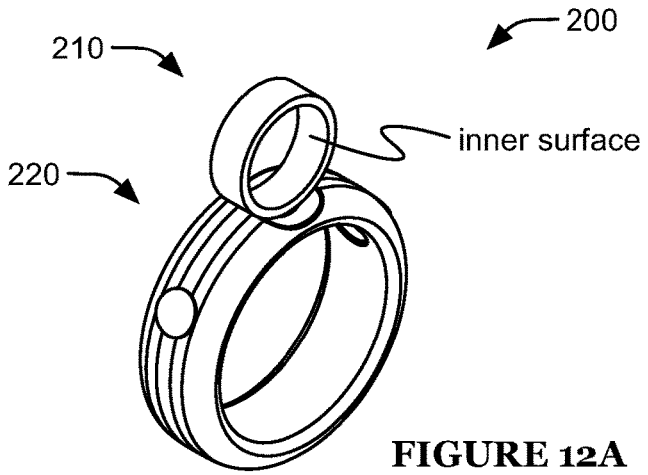
FIGS. 12A-12B are an isometric view and a side view, respectively, of a first specific example of an accessory.
Figure 12B:
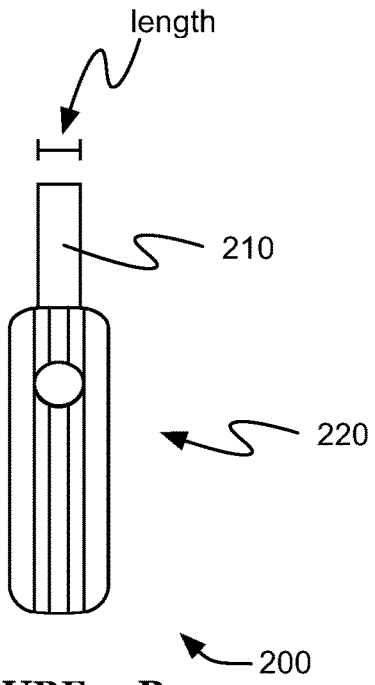
Figure 12C:
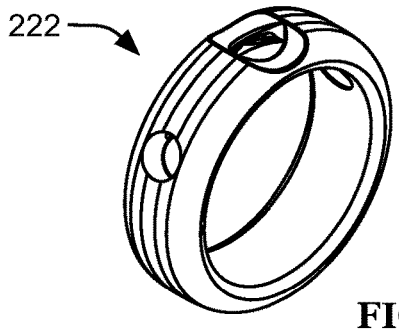
FIGS. 12C-12D are isometric views of a first and second portion, respectively, of the first specific example of the accessory.
Figure 12D:
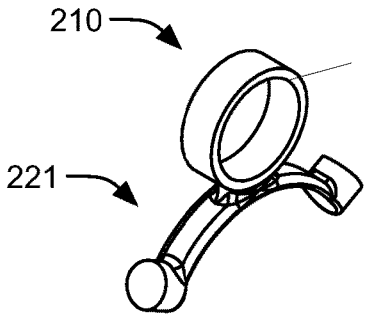
Figure 12E:
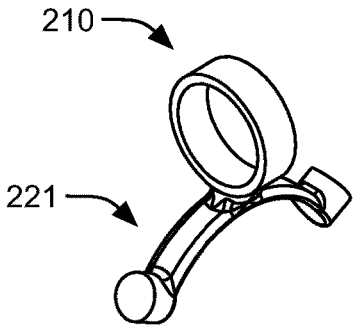
FIG. 12E is an isometric view of an alternate example of the second portion of the first specific example of the accessory.
Figure 13A:
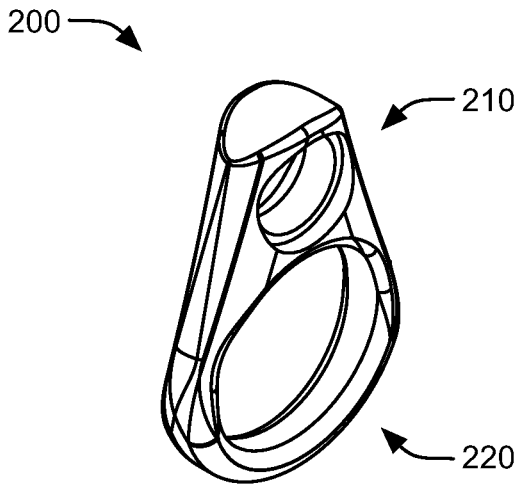
FIGS. 13A-13C are an isometric view, a front view, and a side view, respectively, of a second specific example of an accessory.
Figure 13B:
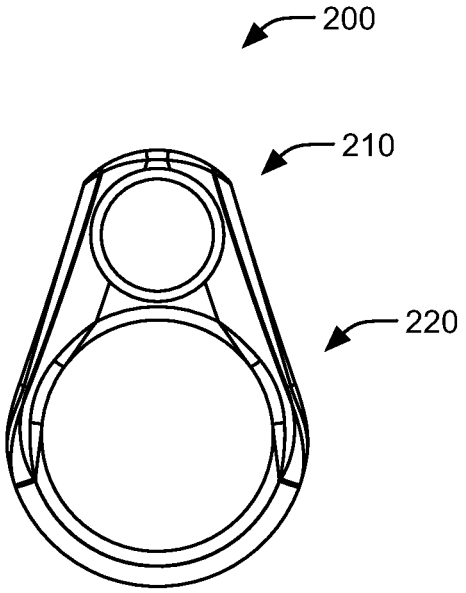
Figure 13C:
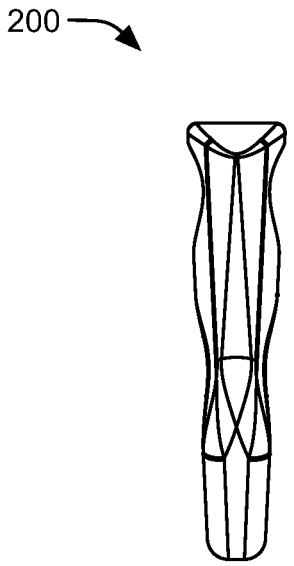

The excitation device Dm preferably includes one or more housings 110, and can additionally or alternatively include one or more additional elements, such as one or more: stimulation units, power modules (e.g., configured to power the stimulation units and/or other elements of the excitation device), sensors, user input elements, communication modules, processors and/or control modules (e.g., configured to control operation of the stimulation units, such as in response to inputs received from the user input elements and/or communication modules), and/or any other suitable elements (e.g., as shown in FIGS. 10E-10F and/or 11E-11F). For example, the excitation device 100 can include one or more elements such as described (and/or can be substantially as described) in U.S. patent application Ser. No. 15/433,879, filed 15 Feb. 2017 and titled "Vibratory Actuator and Device for Sexual Stimulation", and/or U.S. patent application Ser. No. 15/843,240, filed 15 Dec. 2017 and titled "System and Method for Sexual Stimulation", each of which is herein incorporated in its entirety by this reference (e.g., the excitation device 100 can include one or more elements described regarding the "device 100" of U.S. patent application Ser. No. 15/433,879 and/or the "excitation device 100" of U.S. patent application Ser. No. 15/843,240).

2.1.1 Housing.

The housing 110 preferably functions to retain the other excitation device elements. The excitation device components can be contained within the housing (e.g., enclosed by the housing, press-fit into the housing, etc.), retained at a surface of the housing (e.g., adhered to the surface, mechanically fastened to the surface, etc.), and/or otherwise retained by the housing.

In some embodiments, the excitation device 100 includes multiple housings. The excitation device preferably includes two housings (a first housing 110*a* and a second housing 110*b*), but can alternatively include any suitable number of housings. The housings are preferably operable to be attached to one another (and/or detached from one another, such as removably detached and reattached), such as by a friction fit mechanism, threaded coupling, bayonet mount, pawl latch, and/or any other suitable coupling or couplings (e.g., as described in U.S. patent application Ser. No. 15/433,879, filed 15 Feb. 2017 and titled "Vibratory Actuator and Device for Sexual Stimulation", which is herein incorporated in its entirety by this reference). In such embodiments, the elements can all be enclosed by a single housing, some of the elements can be enclosed in each of multiple housings, and/or the elements can be arranged in any other suitable manner. In one embodiment, the first housing is a stimulation housing (e.g., enclosing the stimulation unit(s)) and the second housing is a power and/or control housing (e.g., enclosing the power and/or control modules, defining the user input elements, etc.), such as described by way of example in U.S. patent application Ser. No. 15/433,879 (e.g., wherein the first housing corresponds to the "interaction module no" and the second housing corresponds to the "power module 120").

The housing 110 of the excitation device (or, for excitation devices including multiple housings, one or more of the housings, such as all of the housings together when attached to each other) preferably defines an overall shape, more preferably an elongated shape defining a long axis (e.g., a central axis directed along the shape's overall elongation), but alternatively a shape defining any other suitable structures. In some examples, the housing can define a substantially cylindrical or prolate spheroidal shape, a rectangular prismatic shape, and/or any other suitable shape.

Figure 3A:
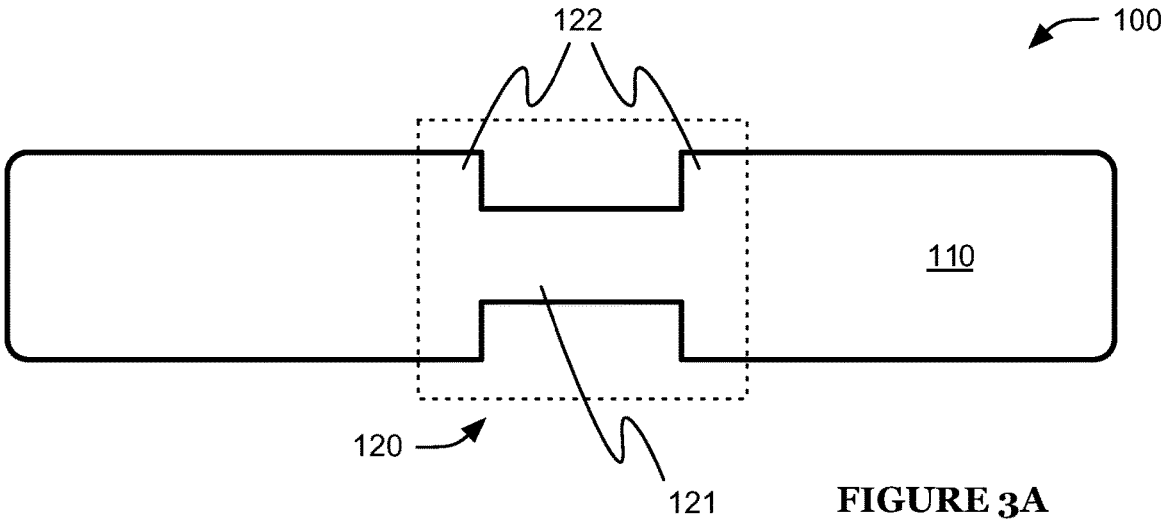
FIGS. 3A-3B are schematic representations of side views of a first and second variation, respectively, of an excitation device of the system.
Figure 3B:
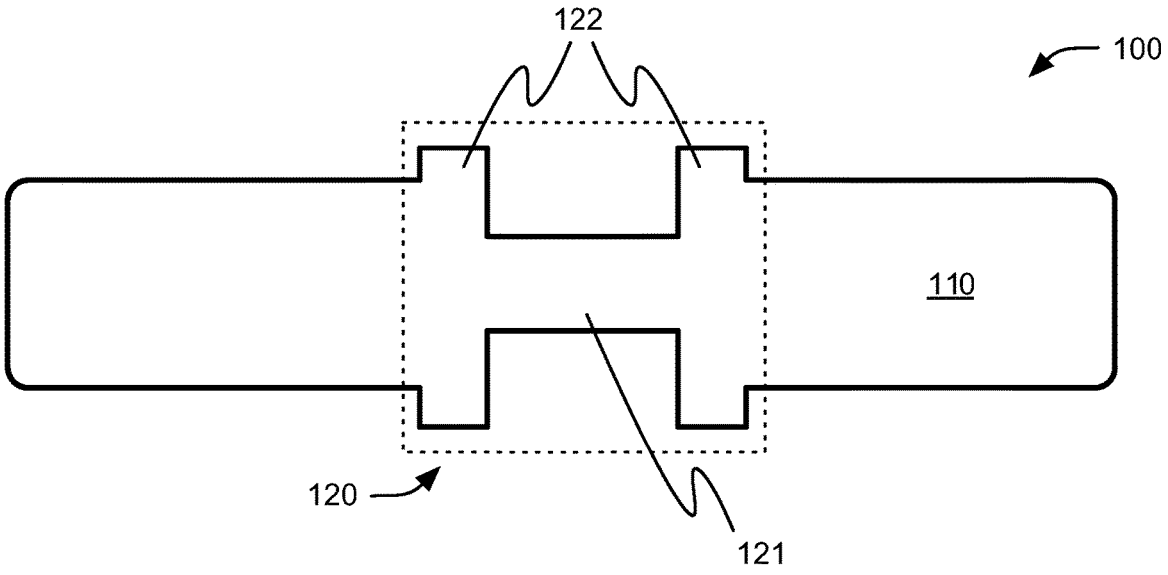

The housing preferably defines one or more retention elements 120. The retention element 120 preferably functions to retain one or more mating elements 210 (e.g., as described below in more detail). The retention element 120 preferably includes a bridge member 121, one or more flanges 122, and/or any other suitable structures (e.g., as shown in FIGS. 3A-3B).

The bridge member 121 can define a substantially constant cross-section along its length, a tapered cross section, and/or have any other suitable profile. The cross-section of the bridge member can be circular, ovoid, rectangular, and/or have any other suitable shape. The bridge member can define a bridge axis (e.g., central axis of the bridge member), which is preferably substantially parallel with (and more preferably, substantially collinear with) the long axis of the housing. In some examples, the bridge member defines a structure that is substantially rotationally symmetric (e.g., axisymmetric) about the bridge axis. For example, the bridge member can define a substantially cylindrical structure (e.g., with a central axis substantially concentric with the long axis of the housing). However, the bridge member 121 can additionally or alternately define any other suitable shape. The bridge member 121 preferably defines a bridge width (e.g., a dimension describing the bridge cross-section, such as a diameter, a short or long side length of a rectangle, an inscribed or circumscribed circle diameter, etc.). The cross-section is preferably defined within one or more planes normal to the bridge member central axis and/or the housing long axis, but can additionally or alternatively be defined within planes normal to any other suitable axes (and/or any suitable curves). The bridge member 121 preferably defines a bridge length (e.g., distance between elements arranged on either side of the bridge member, such as between shoulders defined by the flanges 122; preferably a distance along the axis (or curve) defining the cross-sections). However, the bridge member 121 can additionally or alternatively define any other suitable structure(s).

Figure 4:
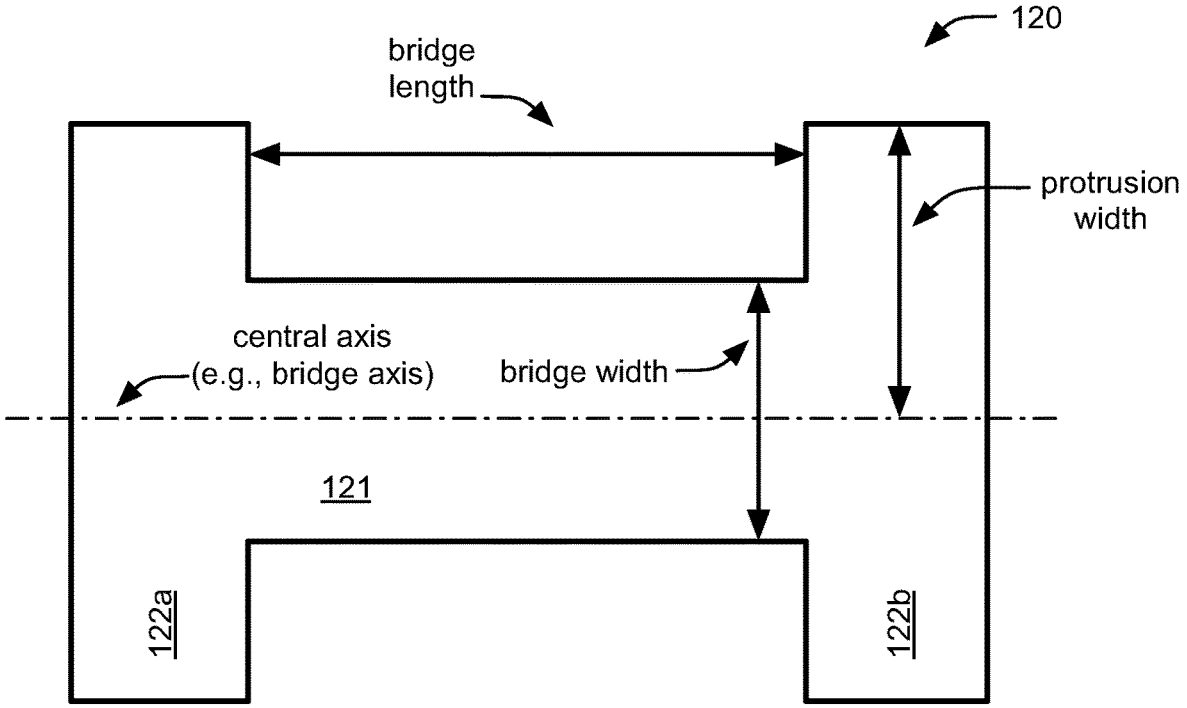
FIG. 4 is a schematic representation of a side view of an embodiment of a retention element of the system.
Figure 5A:
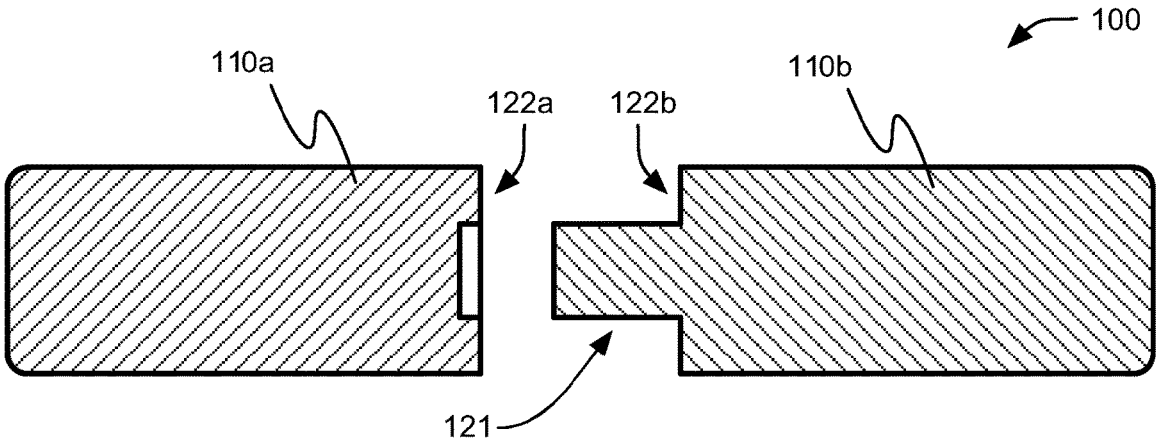
FIGS. 5A-5B are schematic representations of cross-sectional side views of a third variation of the excitation device, in a separated and connected configuration, respectively.
Figure 5B:
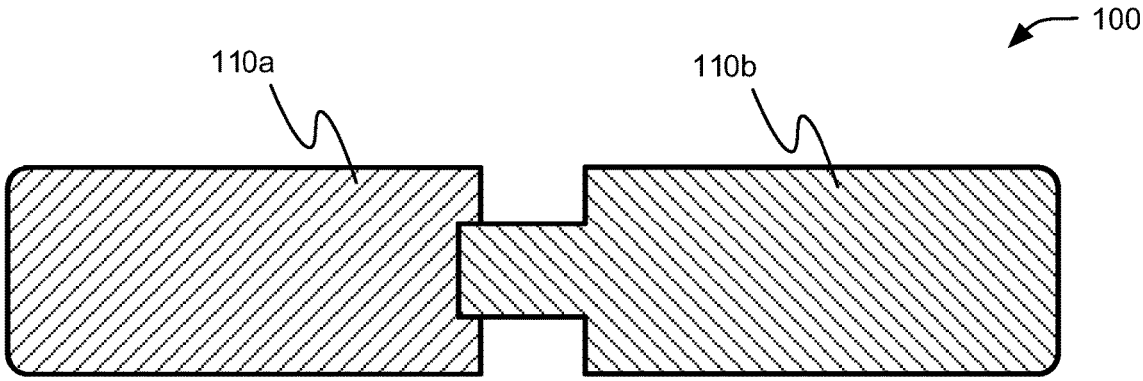
Figure 5C:
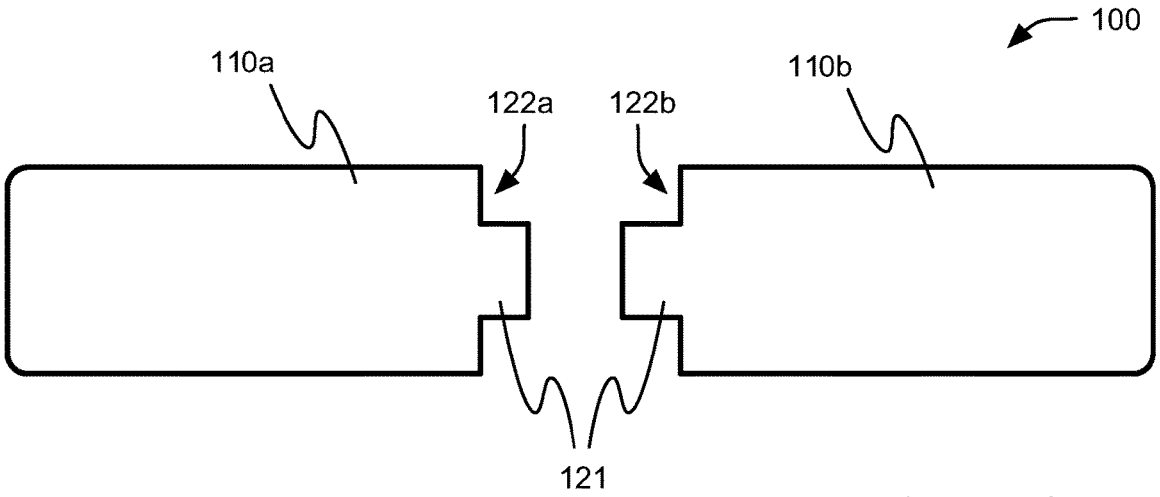
FIGS. 5C-5D are schematic representations of side views of a fourth variation of the excitation device, in a separated and connected configuration, respectively.
Figure 5D:
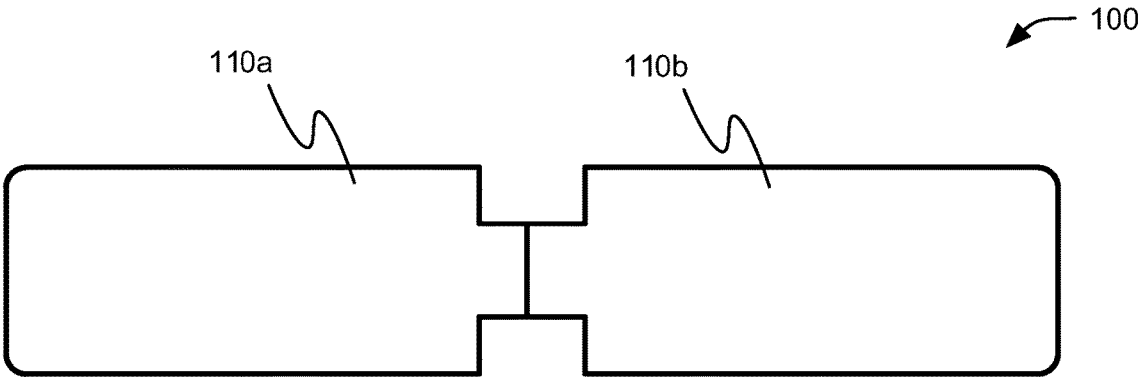

The retention element 120 preferably includes two flanges 122*a*, 122*b* (e.g., as shown in FIG. 4), but can alternatively include any other suitable flanges 122. The flanges are preferably arranged on either side of the bridge member (e.g., opposing each other across the bridge member, preferably along the bridge axis). The flanges are preferably substantially rotationally symmetric (e.g., axisymmetric) about the bridge axis, but can additionally or alternatively have any other suitable symmetry (or no symmetry). Each flange preferably defines a protrusion width. The protrusion width is preferably measured as the distance from the bridge axis to the outermost point of the flange (the flange extremum). In some embodiments, the protrusion width is a radius, such as one half of an outer diameter (OD) of a flange with a circular cross-section (e.g., a substantially cylindrical flange). The protrusion width can be the same, less, or more than a characteristic width of the excitation device (e.g., the overall width of the excitation device, ignoring the flanges).

Each flange preferably defines a shoulder (e.g., abutting the bridge member). The shoulders preferably define a substantially planar surface (e.g., substantially normal to the bridge axis). However, the shoulders can additionally or alternatively define a beveled, chamfered, tilted (e.g., wherein the shoulders define substantially planar surfaces that are not substantially normal to the bridge axis, such as surfaces substantially parallel each other or defining any other suitable angle with respect to each other), or otherwise angled or curved surface (e.g., sloped away from the bridge, such as defining an obtuse angle with the bridge axis; overhanging the bridge, such as defining an acute angle with the bridge axis; etc.), can define a wavy, angular, and/or otherwise non-flat surface, and/or can define any other suitable shapes and/or orientations. However, the flanges 122 can additionally or alternatively define any other suitable structures.

In embodiments including multiple housings, each housing preferably includes one of the two flanges (e.g., as shown in FIGS. 5A-5D). In such embodiments, when the two housings are mated, the retention element is preferably defined cooperatively by the two housings. In some such embodiments, each housing includes a portion of the bridge member, whereas in other such embodiments, the bridge member is defined entirely by one of the housings.

In some embodiments, the retention element 120 defines one or more grooves (e.g., in which the mating element of the accessory can sit when mated to the excitation device), preferably wherein the groove is cooperatively defined by the bridge member and the flanges (e.g., the shoulders of the two flanges). In a first embodiment, the groove encircles the bridge member (e.g., about the bridge axis); in this embodiment, the groove is preferably substantially rotationally symmetric (e.g., axisymmetric) about the bridge axis, but can additionally or alternatively have any other suitable symmetry and/or orientation. In a second embodiment, the groove does not fully encircle the bridge member, but rather is defined only along one or more sides or regions of the bridge member (e.g., wherein the mating element of the accessory is configured to encircle the bridge member, sitting in the groove where it is present and sitting proud where it is not; wherein the mating element is configured to sit in the groove and not encircle the bridge member; etc.). For example, the mating element can be clamped between (and/or otherwise held captive by) the flanges (e.g., and thereby retained within the groove). However, the groove can additionally or alternatively define any other suitable shape, and/or the retention element can additionally or alternatively define any other suitable structures.

The retention element 120 is preferably arranged near the center of the excitation device (e.g., along the long axis), which can result in a balanced structure (e.g., more evenly balanced than structures in which the retention element is arranged farther from the center of the excitation device). The center at or near which the retention element is arranged can be the center of mass, the spatial center, and/or any other suitable central position. Alternatively, the retention element can be arranged near one end of the housing (e.g., along the long axis) and/or in any other suitable locations.

Housing material selection can affect transmission of stimuli (e.g., vibrations) from the stimulation unit(s) directly into the body of the user and/or into other elements of the system (e.g., the accessory, other housings and/or additional elements of the excitation device, etc.). The housing is preferably a substantially rigid material, such as plastic or metal, which can function to reduce low-frequency vibration transmission to other elements of the system. The housing can be machined from billet, die cast, investment cast, stamped, etched, injection molded, stamped, formed, and/or manufactured according to any other suitable techniques or methods. For example, the housing can include (e.g., be or consist essentially of) zinc (e.g., diecast zinc), aluminum (e.g., machined aluminum), stainless steel (e.g., machined stainless steel, stamped from stainless steel sheet, etc.), rigid and/or semi-rigid polymers such as injection molded high-density polyethylene (HDPE) and/or nylon, and/or any other suitable materials. The housing can additionally or alternatively include one or more materials that are substantially elastic or flexible, such as with a resonant frequency outside of an operating frequency range of the vibratory actuators. For example, the housing can include (e.g., be) one or more flexible materials such as an elastomer (e.g., silicone rubber) or other flexible polymer (e.g., can be fabricated as molded rubber). The housing materials can be transparent, translucent, or opaque. However, the housing can additionally or alternatively include any other suitable materials, and/or can be manufactured via any other method or combination of methods.

The housing 110 can optionally function to define one or more sealed enclosures containing some or all of the other excitation device elements. For example, the housing can prevent or reduce ingress of fluids (e.g., water and/or other liquids, gasses, etc.), dust, and/or other substances into the sealed enclosure(s), and/or can fluidly isolate the sealed enclosure(s) from the ambient environment.

However, the housing or housings can additionally or alternatively include any other suitable elements in any suitable arrangement, and/or can additionally or alternatively serve any other suitable functions.

2.1.2 Additional Excitation Device Elements.

The excitation device 100 preferably functions to provide a stimulus (e.g., haptic stimulus, such as a vibratory stimulus) to a user. For example, the excitation device can include one or more stimulation units that function to stimulate a user, preferably by stimulating a soft tissue of the user. The stimulation units are preferably configured to stimulate one or more body parts, preferably including external female sex organs, such as the clitoris, labia, vulva, perineum, anus, nipple, breast, and/or areola, but additionally or alternatively including: male sex organs, such as the penis, scrotum, perineum, and/or anus; internal sex organs, such as the vagina, G-spot, prostate, and/or rectum; and/or any other internal or external portion of the body of a user, such as the neck, ear, arm, thigh, foot, kneecap, hand, elbow, armpit, and/or cheek.

Each stimulation unit preferably includes a vibratory element that generates vibratory stimulation through an electromechanical actuator, such as an electric motor coupled to a counterweight, a piezoelectric transducer coupled to a mass, a charged diaphragm coupled to a mass, a magnetic vibrator, or any other linear or rotary actuator manipulating an (eccentric) mass to generate a vibration. Furthermore, the counterweight or mass can include a bladder system with a hydraulic or pneumatic cavity configured to fill and drain to adjust the vibratory output or "feel" of the vibratory actuator. However, the stimulation units can additionally or alternatively include any one or more of a heating element, a cooling element, a suction element, a pump, a fan, a linear or non-linear actuator, a bladder, a phase change material, a shape memory material (e.g., Nitinol), a set of electrodes to output electrical shocks or pulses to a portion of the body of the user, lights or a display to output visual cues, a smell module to provide olfactory sensations, a speaker or other audio generator, or any other suitable stimulatory unit, element, or component. The excitation device 100 can include one or more stimulation units of the same or different types.

The excitation device 100 preferably includes one or more power modules. The power module preferably functions to supply power to the stimulation units and/or any other suitable excitation device elements. The power module can be located inside the housing, on a housing surface, or in any other location.

The power module preferably includes a power storage element. The power storage element preferably includes a battery, more preferably a secondary battery but alternatively a primary battery, but can additionally or alternatively include a capacitor (e.g., to facilitate fast discharging in combination with a battery), a fuel cell with a fuel source (e.g., metal hydride), and/or any other suitable power storage element. The secondary battery can have a lithium phosphate chemistry, lithium ion polymer chemistry, lithium ion chemistry, nickel metal hydride chemistry, lead acid chemistry, nickel cadmium chemistry, metal hydride chemistry, nickel manganese cobalt chemistry, magnesium chemistry, or any other suitable chemistry. The primary battery can have a lithium thionyl chloride chemistry, zinc-carbon chemistry, zinc chloride chemistry, alkaline chemistry, oxy nickel hydroxide chemistry, lithium-iron disulfide chemistry, lithium-manganese oxide chemistry, zinc-air chemistry, silver oxide chemistry, or any other suitable chemistry. The battery is preferably electrically connected to the powered excitation device components (e.g., wherein a control module controls power provision, such as through component operation mode control), but power provision and/or battery management can alternatively be performed by any other suitable component.

The power module can additionally or alternatively include a power input element (e.g., to charge the battery, to directly power the excitation device elements, etc.). The power input element preferably includes a conductive electrical connector (e.g., USB connector, coaxial connector, etc.) and/or inductive coupling element (e.g., configured to receive power inductively from an inductive charging device), but can additionally or alternatively include a thermal energy converter (e.g., thermionic converter, thermoelectric converter, mechanical heat engine, etc.) optionally with a heat source (e.g., radioactive material), a mechanical energy converter (e.g., vibrational energy harvester), a solar energy converter, and/or any other suitable power input element.

The excitation device 100 can optionally include one or more user input elements, which can function to receive control inputs from a user. For example, the excitation device 100 can include user input elements such as described in U.S. patent application Ser. No. 15/843,240, filed 15 Dec. 2017 and titled "System and Method for Sexual Stimulation", each of which is herein incorporated in its entirety by this reference (e.g., as described regarding the "input regions 153"). The user input elements are preferably arranged on and/or near the housing no, but can additionally or alternatively have any other suitable arrangement. A user input element can be a button, flexswitch, touch sensor (e.g., capacitive, resistive), and/or any other suitable input. Additionally or alternatively, the user input elements can include a dial, a slide, a series of toggle switches, and/or other type of input region, button, and/or control. For example, the user input elements can include a dial, through which the user can adjust the stimulation intensity, and a momentary mechanical pushbutton, through which the user can power the excitation device 100 on and off and/or cycle through available modes (e.g., vibratory pattern settings). Additionally or alternatively, the user input elements can include a spatial sensor (e.g., accelerometer) that functions to receive control inputs from the user. For example, the accelerometer can cycle through device settings (e.g., power settings, output intensity settings, etc.) in response to detecting a signal indicative of a tap (e.g., fingertap) on the housing 110, and/or can map detected excitation device movements to device settings. However, the user input elements can additionally or alternatively include elements of any other suitable types, capture any other suitable user input, and/or modify operation of the excitation device 100 in any other suitable manner.

The excitation device 100 can optionally include a communication module, which functions to receive wireless communications (e.g., via WiFi, Bluetooth, cellular radio, etc.) from other devices and/or computing systems. The communication module can be contained within the housing 110, and is preferably electrically coupled to the power module and the control module, and operable to transmit data to and/or be controlled by the control module. The communication module can include one or more radios for the same or different protocol (e.g., capable of communicating and/or configured to communicate using the same or different communication protocol). For example, the communication module can receive control instructions from a remote device (e.g., user device, remote computing system, etc.). The control instructions can be instructions to operate in a mode or with a specific predefined output pattern, instructions to change an output intensity, instructions to define a new output pattern, and/or any other suitable instructions. The communication module can additionally or alternatively transmit control instructions and/or other information (e.g., sensor measurements, control device positions, etc.) to a remote device (e.g., user device, remote computing system, etc.). For example, the communication module can transmit control instructions to a communication module of another excitation device, enabling actuation of both excitation devices' stimulation units in a complementary manner (e.g., substantially similar manner, synchronized actuation, actuation at proportional intensities, etc.). However, the communication module can additionally or alternatively receive and/or send any other suitable wireless communications.

The excitation device 100 can optionally include one or more control modules (e.g., processors, microcontrollers, logic boards, control circuits, etc.). The control module preferably functions to control operation of the excitation module (e.g., of the stimulation unit(s)), such as in response to inputs received from the user input elements and/or communication modules. For example, the control module can control the stimulation unit(s) to transition between different operation modes (e.g., on, off, different actuation patterns, etc.) in response to receipt of inputs at the user input element(s). However, the excitation device can additionally or alternatively include any other suitable control modules.

In some embodiments, operation of the excitation device can be controlled and/or limited based on the accessory, such as based on the presence (e.g., in a mated configuration), type, and/or any other suitable aspects of the accessory. For example, the excitation device can be operable to enable (e.g., activate, power, etc.) the stimulation unit when the accessory is in contact with (e.g., mated to) the excitation device, but can be inoperable to enable the stimulation unit when the accessory is not in contact with the excitation device.

Figure 14A:
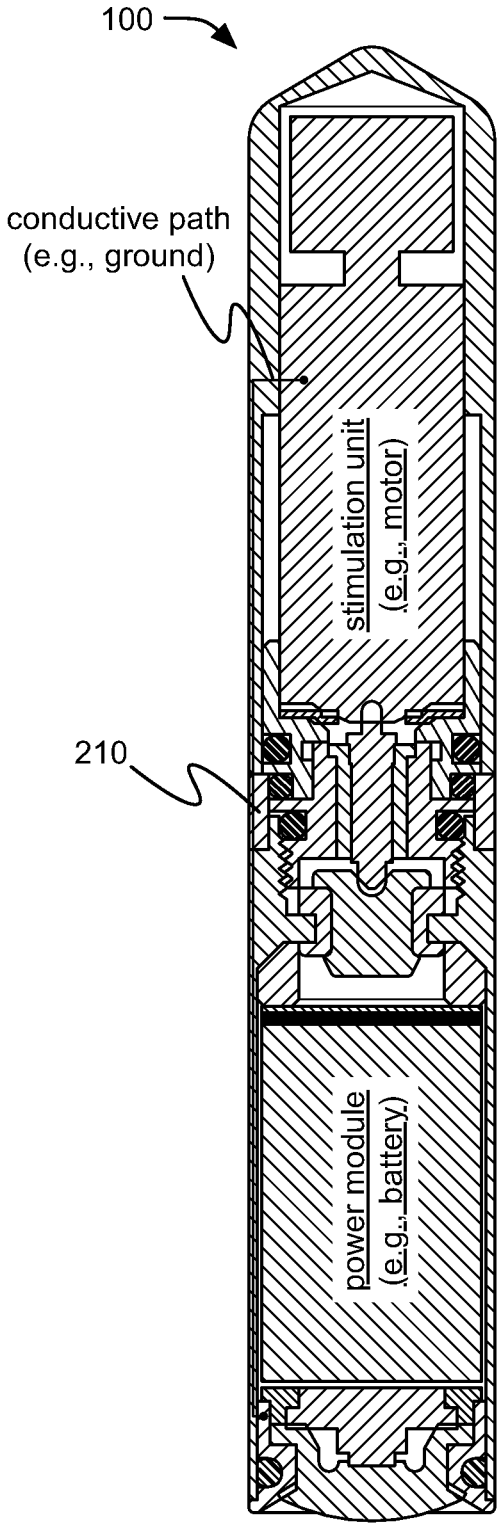
FIGS. 14A-14B are cross-sectional views of the second specific example of the system, in the mated and unmated configuration, respectively.
Figure 14B:
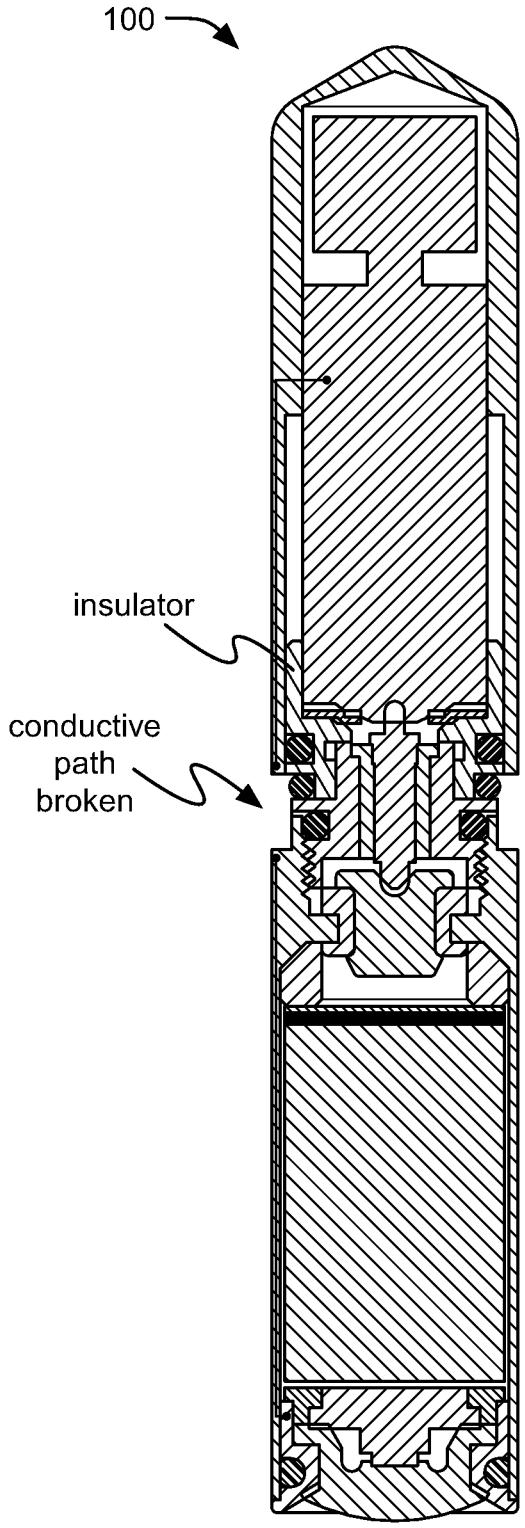

In a first such embodiment, the electrical connection between the power module and the stimulation unit is formed (e.g., in part) by the accessory, such as wherein, in the absence of the accessory, the electrical connection is severed. In this variant, the accessory preferably includes one or more conductive materials (e.g., metal, conductive elastomer such as silicone embedded with a metal powder, etc.) that form part of the electrical connection, electrically coupling the power module to the stimulation unit (e.g., by electrically connecting the first housing to the second housing). For example, when the accessory is mated with the excitation device (e.g., encircling the bridge module, retained between the flanges, etc.), a conductive path (e.g., ground path) between the power module and the stimulation unit can include a first housing portion (e.g., portion of the first housing), the accessory (e.g., the mating element), and a second housing portion (e.g., portion of the second housing). In a specific example, the excitation device can include one or more insulating materials, which can function to prevent direct electrical connection between the first and second housing portions (e.g., between the first and second housings), thereby requiring the presence of the accessory (and/or any other suitable conductive element) to enable operation of the stimulation unit, such as shown by way of example in FIGS. 14A-14B.

In a second such embodiment, the circuit configured to power the stimulation unit includes a switch that is actuated by the accessory. For example, when the accessory is mated to the excitation device, it can actuate a mechanical switch (e.g., maintaining the switch in an 'on' state), thereby enabling the stimulation unit to be powered (e.g., by closing the circuit that powers the stimulation unit). In a first specific example, the mated accessory (e.g., the mating element thereof) depresses the switch (e.g., and holds it in this depressed configuration). In a second specific example, in which the accessory and the switch include one or more magnetic elements, the mated accessory can actuate the switch via magnetic force. However, the switch can additionally or alternatively be actuated in any other suitable manner.

In a third such embodiment, the excitation device includes one or more sensors (e.g., mechanical sensor, magnetic sensor such as Hall effect sensor, optical sensor, electrical sensor such as continuity and/or resistance sensor, etc.) configured to detect the presence (and/or mated state) of the accessory. The sensor(s) can provide a signal (indicative of accessory presence and/or mated state) to the control module, and the control module can control or limit excitation module operation based on the signal. For example, the control module can prevent stimulation unit operation when the accessory is not mated, or the control module can operate the stimulation unit in a first mode when the accessory is mated, and in a second mode when the accessory is not mated. However, excitation device operation can additionally or alternatively be controlled and/or limited based on the accessory in any other suitable manner.

However, the excitation device 100 can additionally or alternatively include any other suitable elements in any suitable arrangement.

2.2 Accessory.

Figure 6A:
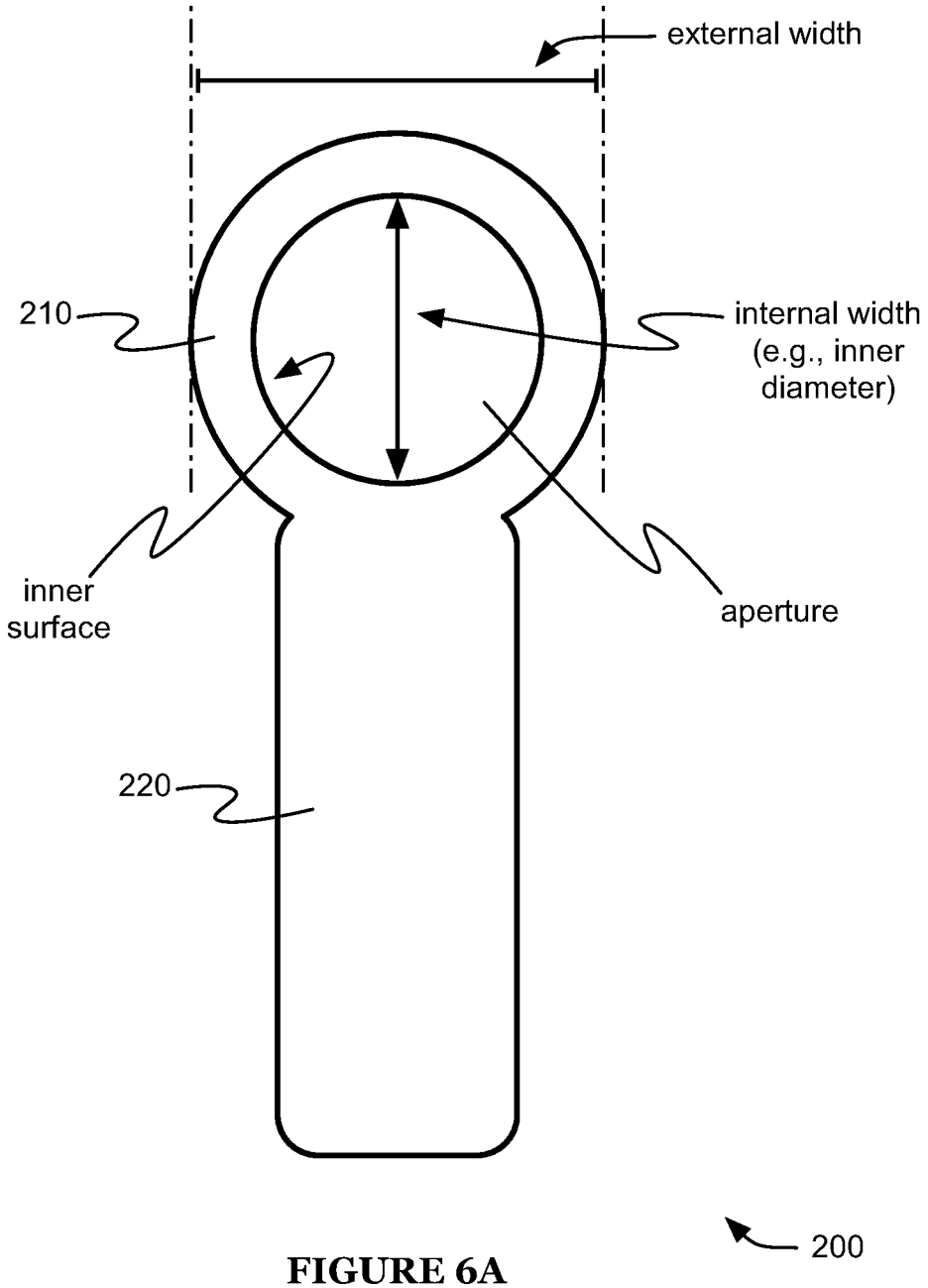
FIGS. 6A-6B are schematic representations of side views of a first and second variation, respectively, of an accessory of the system.
Figure 6B:
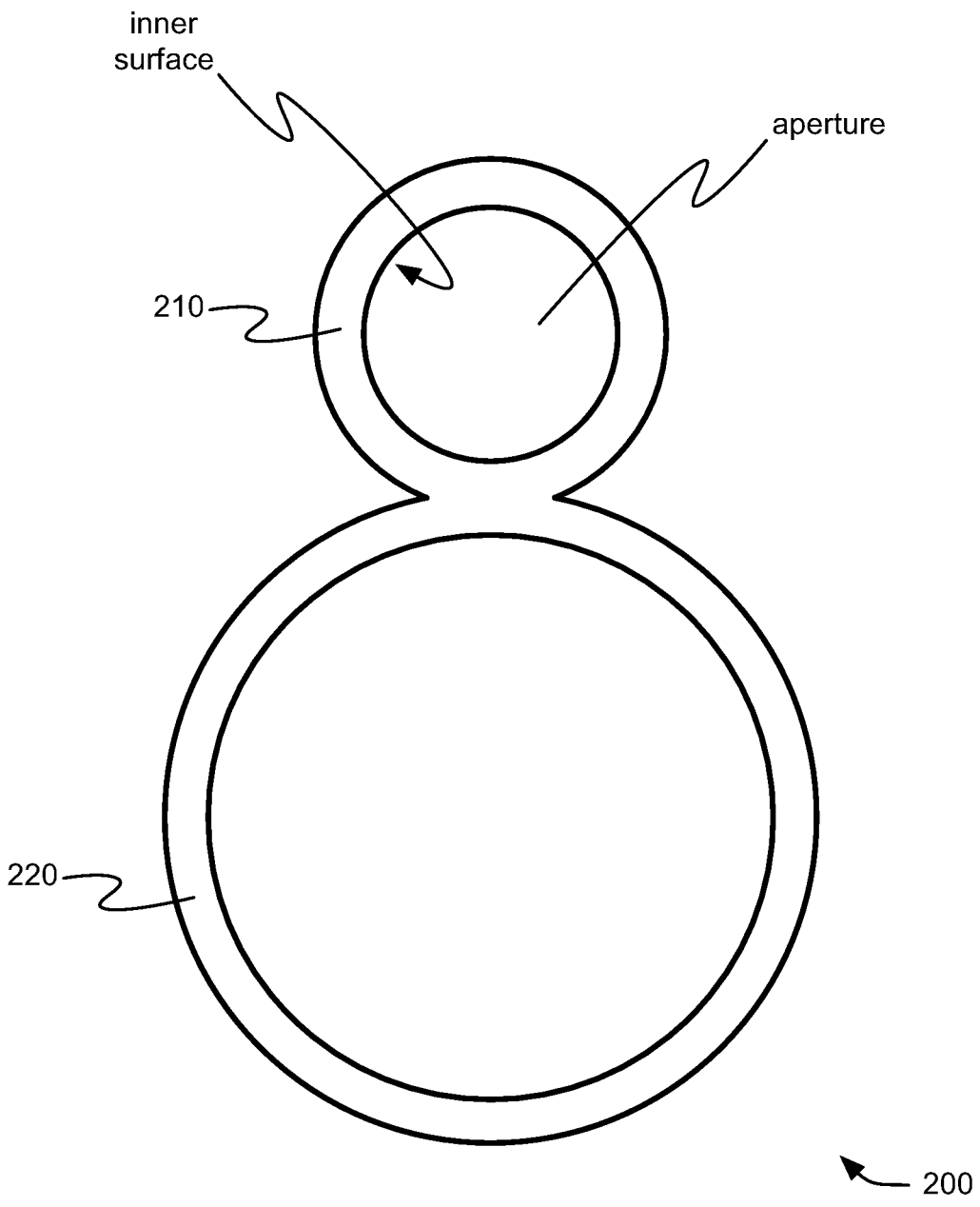

The accessory 200 preferably includes one or more mating elements 210, and can optionally include one or more user interface elements 220 and/or any other suitable elements (e.g., as shown in FIGS. 6A-6B).

2.2.1 Mating Element.

The mating element 210 is preferably configured to be retained by the retention element 120 of the excitation device. For example, the mating element 210 can encircle the retention element (e.g., the bridge member 121) and/or can be captive between portions of the retention element (e.g., between the flanges 122).

The accessory 200 can optionally include multiple mating elements 210. The mating elements can have the same or different specifications (e.g., internal width, length, etc.) from each other (e.g., be configured to mate with the same retention elements and/or with different retention elements). The multiple mating elements can function to enable mating with multiple excitation devices simultaneously, such as wherein one excitation device mates to each mating element of the accessory (or to a subset of the mating elements).

The mating element 210 preferably defines an inner opening complementary to (e.g., fitting around, preferably closely around) the bridge member of the retention element. The inner opening is preferably defined by (e.g., bounded by) an inner surface of the mating element, which can extend between two sides of the mating element (e.g., substantially planar sides, such as substantially parallel sides). The inner opening (e.g., aperture) preferably defines a central axis (e.g., aperture axis) through the aperture (e.g., extending substantially normal to the two sides bounding the inner surface). For example, the inner opening can be substantially rotationally symmetric (e.g., axisymmetric) about the central axis, such as defining a substantially cylindrical aperture. In the mated configuration, the central axis is preferably substantially parallel the bridge axis, more preferably wherein the two axes are substantially collinear, but can additionally or alternatively have any other suitable orientation. In the mated configuration, the inner opening preferably fully encircles the bridge member. However, the inner opening can alternatively encircle the bridge member only partially (e.g., encircling more than 180° around the bridge axis, such as more than 225°, 270°, 315°, etc.), preferably wherein the mating element remains captive around the bridge element.

The mating element preferably defines an internal width (e.g., inner diameter (ID)), an external width (e.g., outer diameter (OD)), and a length (e.g., overall length, such as length along the bridge axis when in the mated configuration; length along the inner opening, such as normal to an axis or curve centered along the opening; distance between the two sides that the inner surface extends between; etc.). The internal and external widths are preferably defined normal to the central axis. The internal width is preferably larger than the bridge width, which can enable the mating element to fit around the bridge element. The internal width is preferably smaller than the protrusion width (e.g., wherein the mating element ID is less than the flange OD), which can enable the flanges to hold the mating element captive. For example, the difference between the maximum internal width (e.g., longest line segment between points on the inner surface that is normal to the central axis and that does not intersect the accessory) and the maximum bridge width can be less than the protrusion widths. In embodiments in which the mating element is substantially rigid, the maximum internal width is preferably no less than (or not substantially less than) the maximum bridge width. Alternatively, the maximum internal width of a deformable mating element (e.g., including an elastomer such as silicone) may be substantially less than the bridge width (e.g., in the unmated configuration, wherein the mating element can deform to fit around the bridge element in the mated configuration).

In some embodiments, the length is less than or substantially equal to the bridge length (e.g., such that the mating element fits between the flanges when in the mated configuration), preferably only less than the bridge length by a small amount (e.g., wherein, in the mated configuration, the mating element is restricted to a small range of motion, or substantially no motion, along the bridge member central axis). In other embodiments, the length is greater than the bridge length, preferably by only a small amount. For example, the mating element can be compressed between the flanges in the mated configuration, thereby deforming the mating element and/or portions of the retention element such as the bridge member and/or flanges (e.g., wherein the compressed mating element defines a compressed length and/or the deformed retention element defines an extended bridge length, preferably such that the compressed length is substantially equal to the extended bridge length), thereby creating a compression fit between the mating element and the retention element (e.g., wherein the mating element is retained by friction with the flanges). However, the mating element can have any other suitable length. The mating element external width can be the same, less, or more than the flange protrusion width. In one example, when in the mated configuration, the mating element exterior surface is substantially flush with the retention element such as wherein the excitation device and mating element cooperatively define a substantially smooth continuous surface, such as the surface of a cylinder, prolate spheroid, or other suitable shape.

In another embodiment, the mating element can be configured to be retained within the retention element without encircling the bridge member. For example, the mating element can include a member configured to be clamped between the flanges of the retention element, preferably wherein such a member is complementary to the structures defined by the retention element (e.g., mating surfaces defining a complementary shape to those of the flanges, such as planar surfaces that, in the mated configuration, are substantially parallel to and coincident with planar mating surfaces of the flanges). In this embodiment, the mating element may not define an inner opening (or alternatively, may define such an opening).

However, the mating element can additionally or alternatively define any other shape, have any other suitable dimensions, and/or be configured to mate with the retention element in any other suitable manner.

In an alternate embodiment, the mating element 210 and retention element 120 can cooperatively define a bayonet mount and/or any other suitable mechanism for retaining the system in the mated configuration. However, the mating element 210 can additionally or alternatively include any other suitable elements in any suitable arrangement.

2.2.2 User Interface Element.

The user interface element 220 preferably functions to couple the accessory to a user, more preferably a human user (e.g., as described in U.S. patent application Ser. No. 15/843,240, filed 15 Dec. 2017 and titled "System and Method for Sexual Stimulation", which is herein incorporated in its entirety by this reference). In some embodiments, the accessory can be worn (e.g., as jewelry), held by a user, retained on or near the user by an article of clothing (e.g., pressed against a user's breast by a bra cup; pressed against the user's genitals by an underwear crotch; held close to the user's body within a clothing pocket or clipped to the clothing, such as to a waistband or bra; hooked or pinned to the clothing; etc.), and/or otherwise retained on or near the user's body. In some examples, the user interface element 220 can include: one or more rings configured to encircle a body part (e.g., finger, penis, wrist, neck, etc.), a necklace (e.g., chain, strap, flexible line, etc.) configured to encircle a user's neck, body piercing (e.g., stud, ring, anchor, etc.), one or more straps (e.g., to be tied around, slung over, and/or otherwise arranged on a user's body, etc.), and/or any other suitable structures. The user interface element 220 can additionally or alternatively include one or more surface attachment mechanisms, such as adhesive (e.g., for adhering the accessory to the user and/or user's clothing), clamps (e.g., for clamping the accessory to the user and/or user's clothing), suction cups, and/or any other suitable attachment structures. The user interface element can additionally or alternatively include one or more structures configured to be retained by a user, such as members (e.g., protruding members) to be retained within a body cavity (e.g., mouth, anus, vagina, etc.), handles (e.g., to be gripped by a user's hands and/or fingers), and/or any other suitable structures.

Figure 7A:
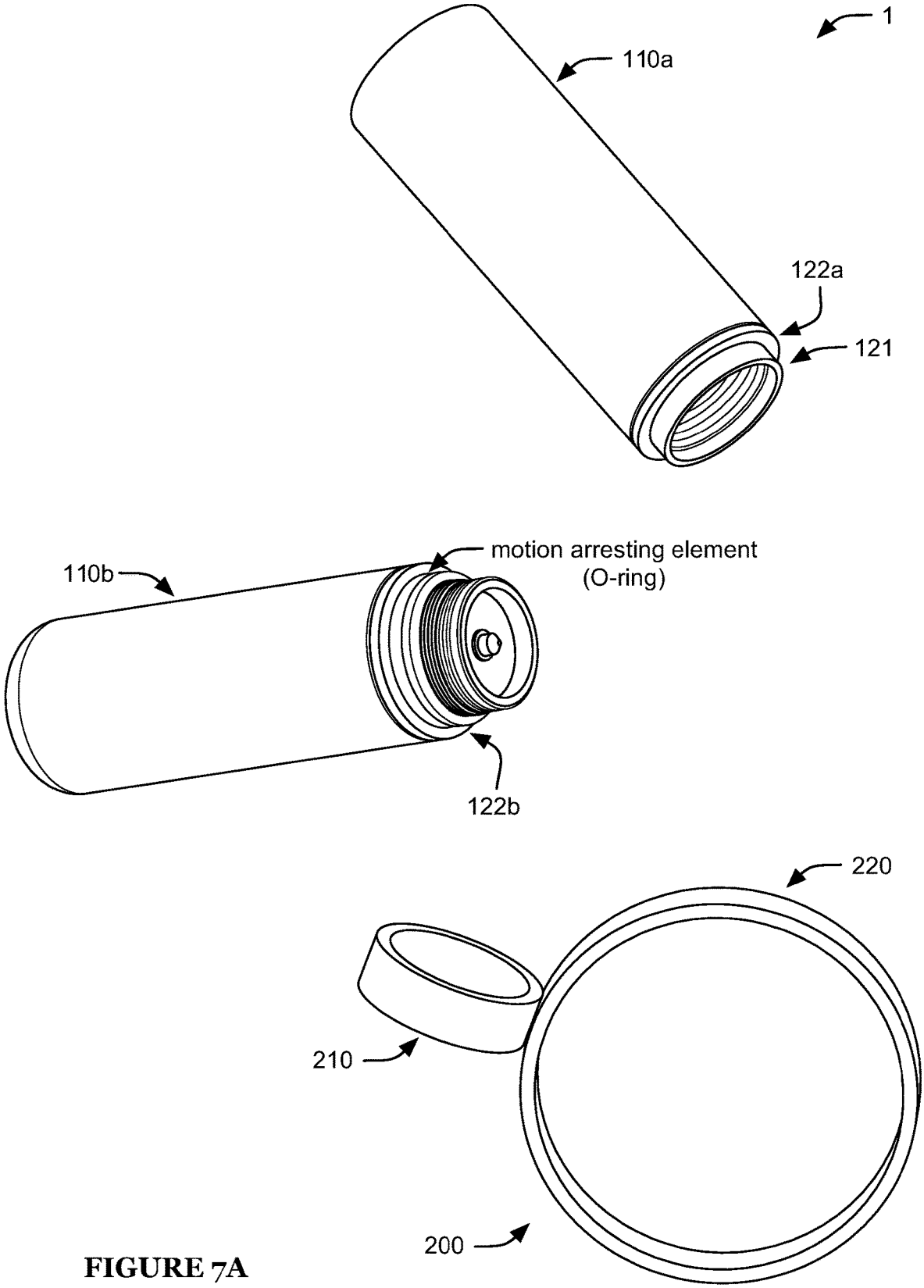
FIG. 7A is a representation of an oblique view of a specific example of the system.

In a first example, the user interface element 220 includes a ring configured to be worn on a user's finger. In a first specific example of this example, the mating element is arranged relative to the ring such that the, such that when in the mated configuration, the long axis of the excitation device is substantially parallel to the user's finger when the ring is worn (e.g., as shown in FIGS. 6B, 10A-10D, 11A-11D, 12A-12D, and/or 13A-13C). In a second specific example, the long axis is at an oblique angle to the finger and/or normal to the finger, preferably wherein the excitation device extends across multiple fingers of the user (e.g., as shown in FIGS. 7A and/or 12E). In a third specific example, the user interface element 220 includes two rings, such as rings to be worn on adjacent fingers of the user.

In some variants of this example, the ring can include portions made of different materials. For example, the ring can include a first portion 221 made of a hard material (e.g., metal, rigid plastic, etc.), partially or entirely covered by (e.g., overmolded by, inserted into, etc.) a second portion 222 made of an elastomeric material (e.g., silicone), such as shown by way of example in FIGS. 9A-9M and/or 12A-12E. The first portion can function to provide rigidity and/or structural definition to the ring, to couple (e.g., rigidly) to the mating element 210 (e.g., wherein the first portion and the mating element 210 are of unitary construction). The first portion preferably does not define a complete encircling structure (e.g., when worn, does not completely encircle the finger). For example, the first portion can extend all or almost of the way around an encircling structure (e.g., having a break across a portion of the encircling structure), can extend between 180° and 360° around, can extend less than 180° around (e.g., 150°, 120°, 90°, 60°, 45°, 30-20-50°, 45-90°, 75-125°, 100-150°, 130-180°, etc.), or can be have any other suitable partially-encircling structure. The second portion can be overmolded on the first portion, such as substantially covering the entirety of the first portion, and/or can be otherwise attached to the first portion. The second portion can function to provide a compliant (e.g., mechanically flexible) interface with a user's finger (and/or other encircled body part), which can reduce transmission of stimuli (e.g., vibrations) from the excitation device to the user's finger, can enable a ring of a particular size to be worn comfortably by users with a larger range of finger sizes, and/or can provide any other suitable benefits. The material of the second portion can additionally or alternatively provide a high-friction interface with the user's finger, thereby reducing movement (e.g., translation, rotation, etc.) of the ring while it is worn (e.g., maintaining the excitation device in a substantially fixed arrangement relative to the finger). In some examples, such variants can provide additional safety to the user (e.g., as compared with a metal ring), such as by reducing or eliminating the possibility of ring avulsion. If the system is caught and/or pulled from the finger while being worn (e.g., by rotating machinery, falling objects, etc.), the material of the second portion can preferably break (e.g., by deformation, by brittle fracture, etc.), thereby freeing the finger from the ring. Alternatively, the ring can include only a single portion (e.g., as shown in FIGS.

13A-13C), such as a rigid (e.g., metal) or deformable (e.g., elastomeric) portion, or can include any other suitable portions.

Figure 8A:
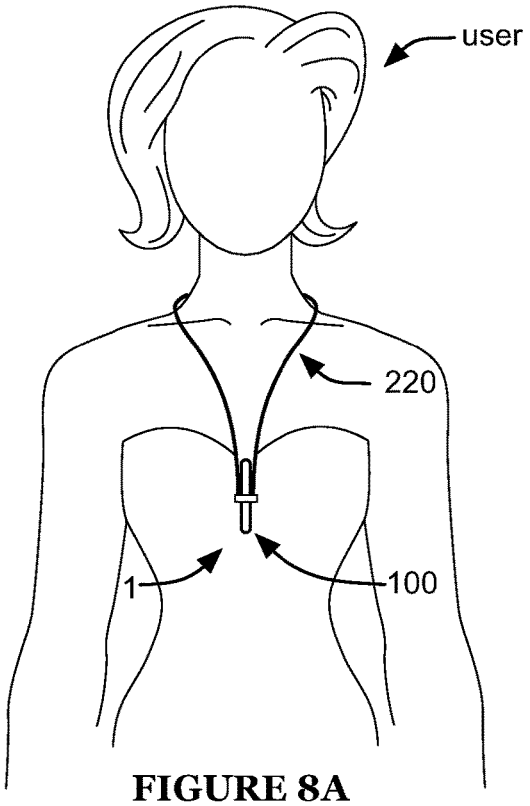
FIGS. 8A-8C are schematic representations of various embodiments of the system.
Figure 8B:
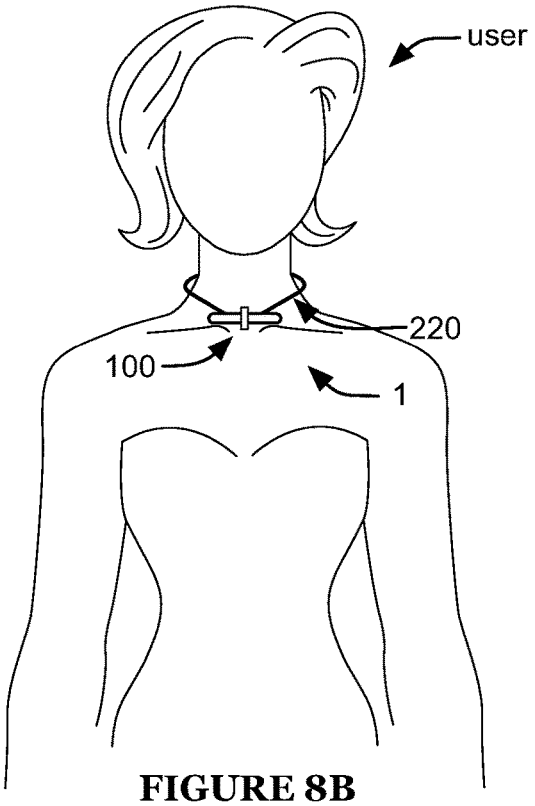

In a second example, the user interface element 220 includes a necklace (e.g., as shown in FIGS. 8A and/or 8B).

Figure 8C:
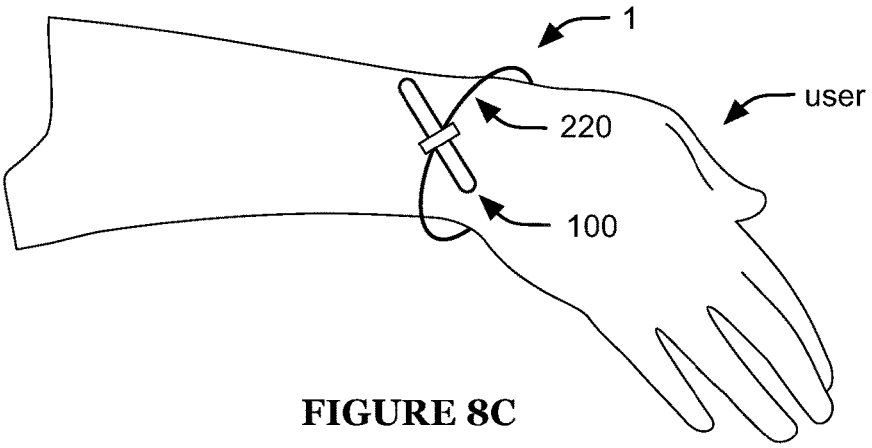
Figure 9A:
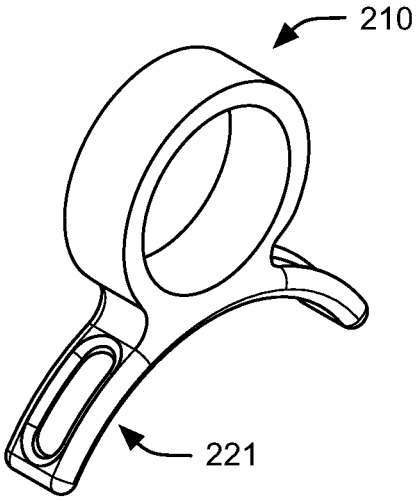
FIGS. 9A-9M are various views of a first specific example of the system or the accessory thereof.
Figure 9B:
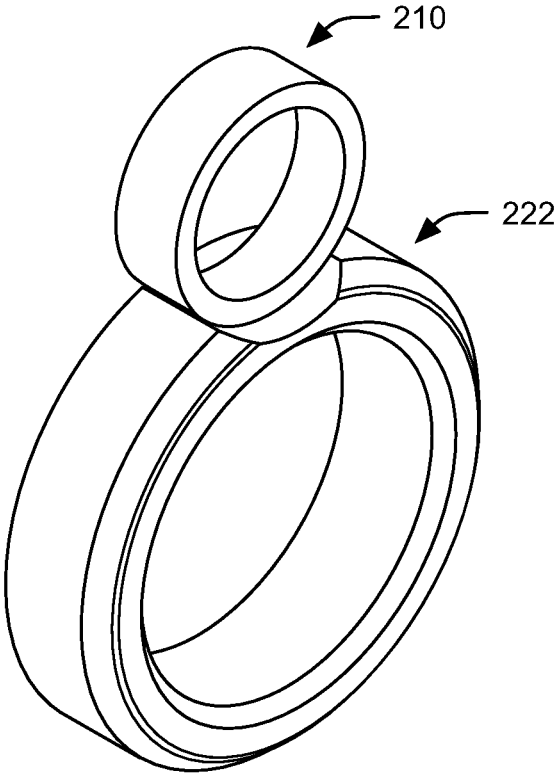
Figure 9C:
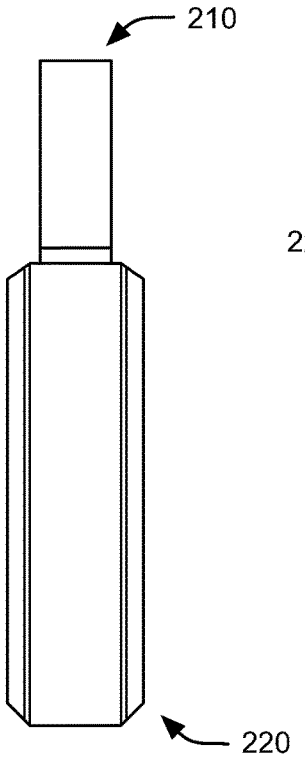
Figure 9D:
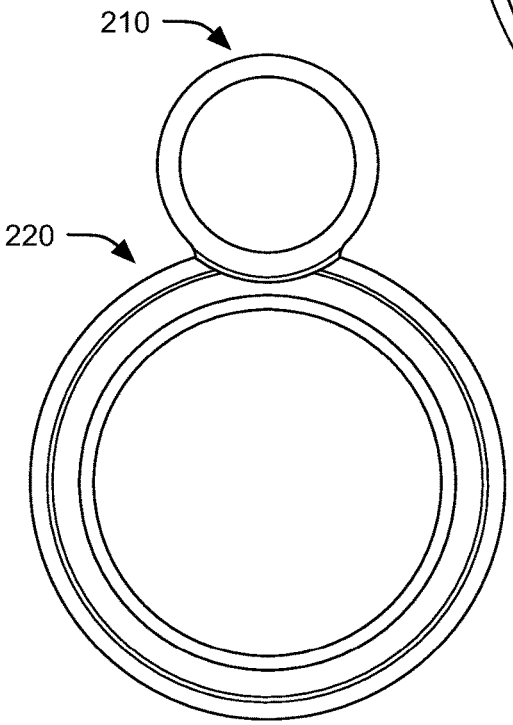
Figure 9E:
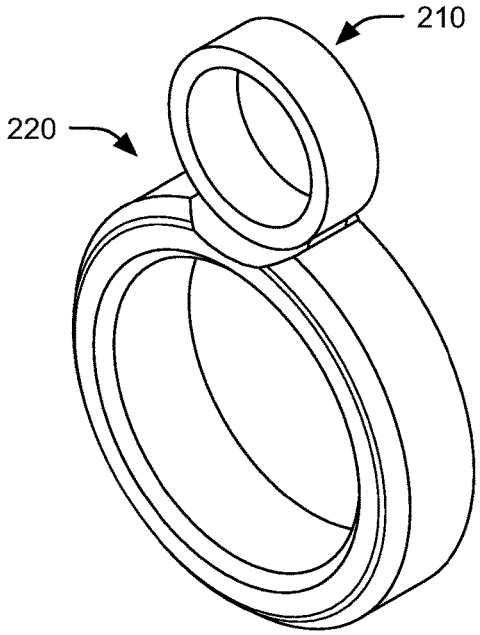
Figure 9H:
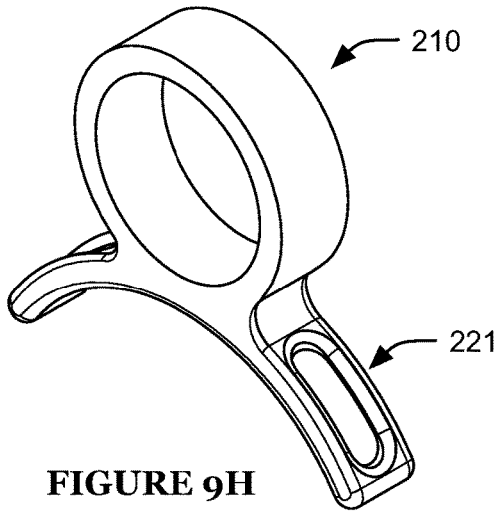
Figure 9F:
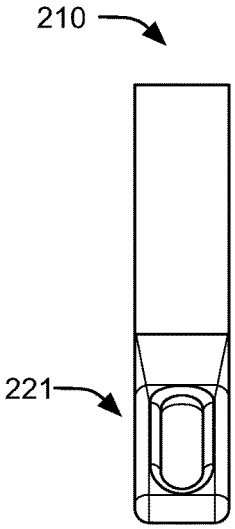
Figure 9G:
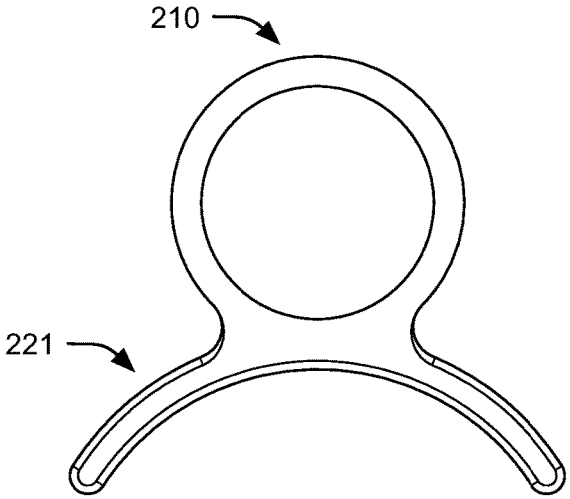
Figure 9I:
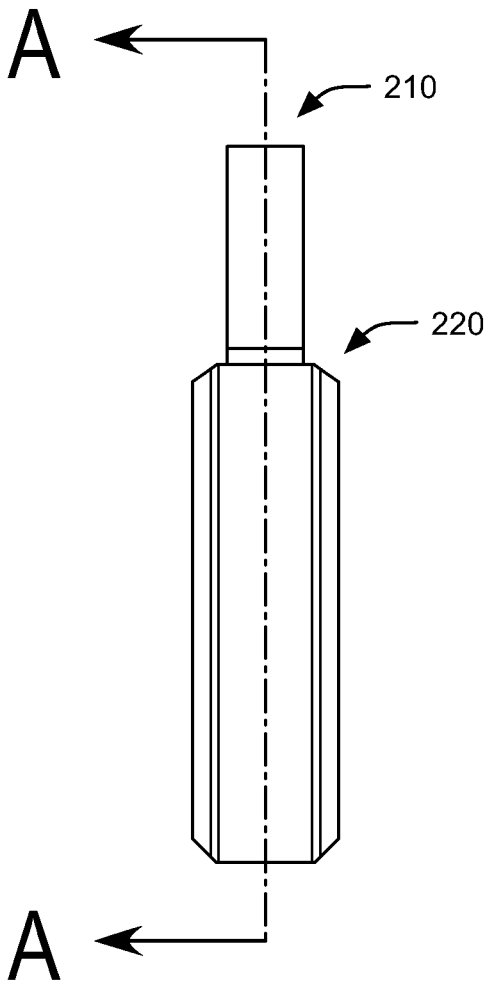
Figure 9J:
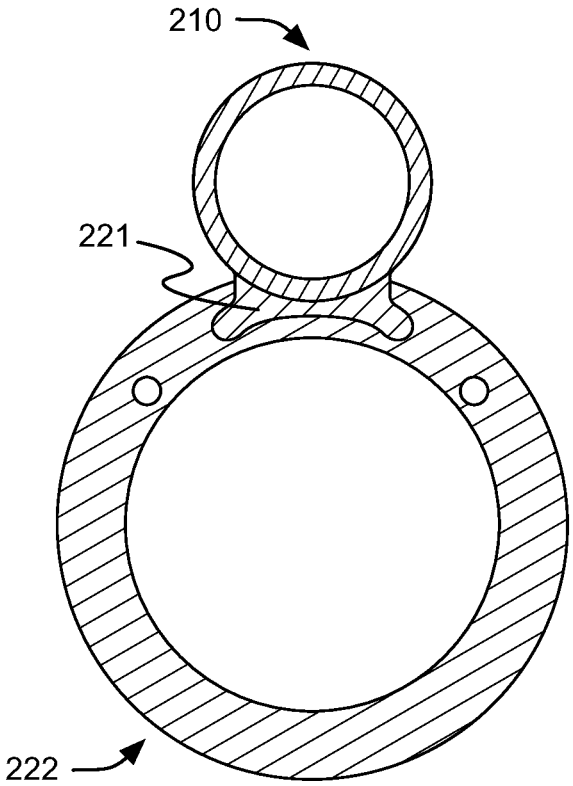
Figure 9K:
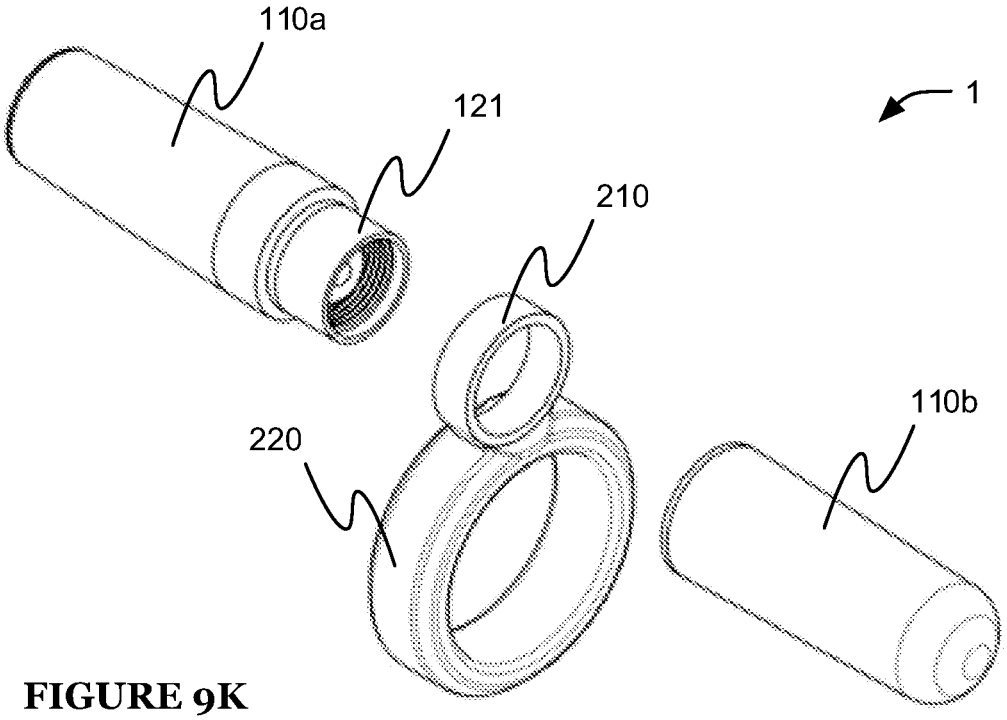
Figure 9L:
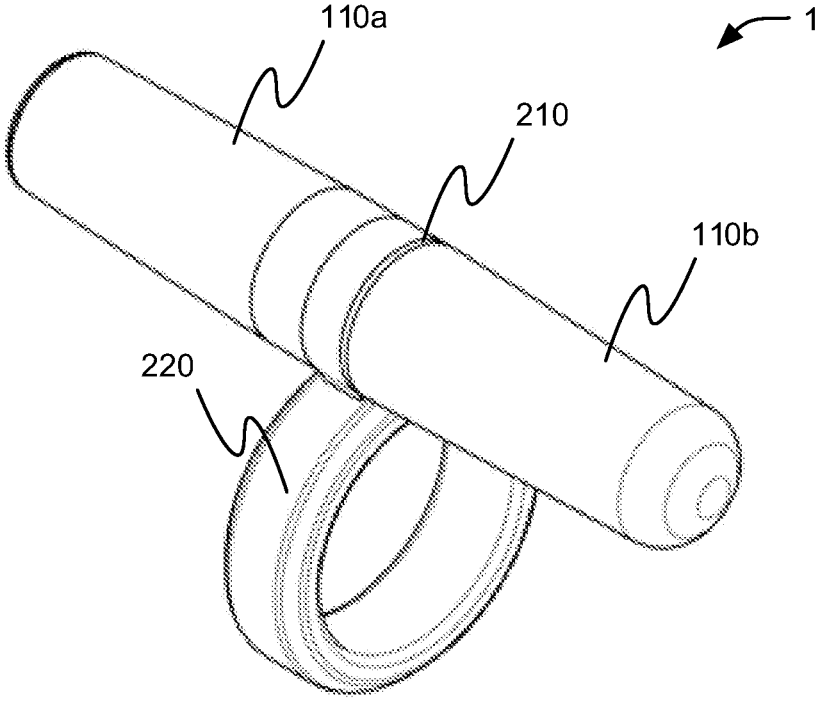
Figure 9M:
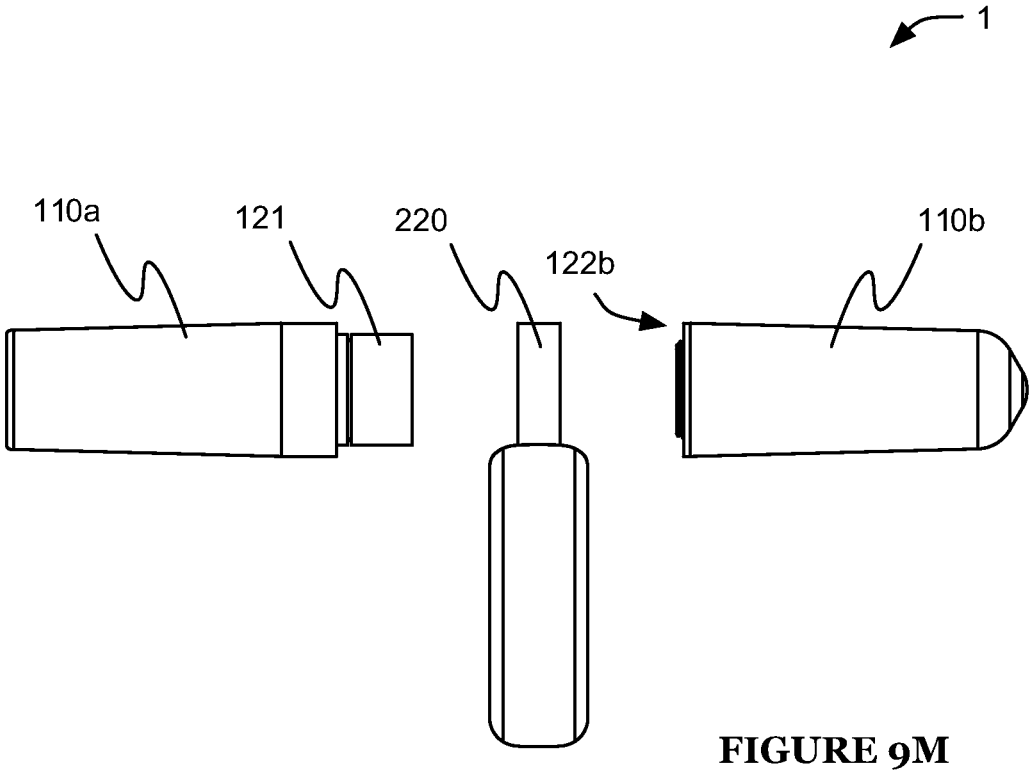

In a third example, the user interface element 220 includes a bracelet (e.g., as shown in FIG. 8C).

In a fourth example, the user interface element can include an extended region, bifurcated into two (or more) retention members (e.g., at one end; joined at multiple locations, such as on either end; etc.), wherein each retention member of the bifurcated section is configured to apply a retaining force, such as an outward force (e.g., radially outward, away from the other bifurcated section, etc.), when the extended region is inserted into a body cavity (e.g., as described in U.S. patent application Ser. No. 15/843,240, filed 15 Dec. 2017 and titled "System and Method for Sexual Stimulation", which is herein incorporated in its entirety by this reference, such as regarding FIGS. 13A-13G of U.S. patent application Ser. No. 15/843,240). The retention members can preferably be moved relative to each other (e.g., can be squeezed closer to one another to facilitate insertion), more preferably exerting a restoring force (e.g., by one or more spring elements, such as a semi-rigid portion of the member or members) in response to such deformation (e.g., the retaining force), but can additionally or alternatively be substantially rigidly coupled (e.g., wherein the retention members are retained by an inward force exerted by the body cavity).

However, the accessory can alternatively include no user interface element (e.g., wherein the accessory includes only the mating element 210). In one such example, in the mated configuration, the accessory and excitation device can cooperatively define a substantially smooth surface (e.g., as described above).

However, the accessory 200 can additionally or alternatively include any other suitable elements in any suitable arrangement.

2.3 Additional Elements.

The system 1 can optionally include any other suitable elements. For example, the excitation device and/or accessory can include one or more motion arresting elements, which can function to prevent and/or reduce relative motion between the excitation device and accessory when in the mated configuration. Such relative motion can include, for example, rotation about a central axis (e.g., excitation device long axis, mating element central axis, etc.), translation (e.g., along the central axis, normal to the central axis, and/or in any other direction), and/or any other suitable motion. In some examples, the motion arresting elements function to prevent or reduce buzzing and/or rattling (e.g., arising from vibrations created by the excitation device). However, the motion arresting elements can additionally or alternatively perform any other suitable functions.

The motion arresting elements can include one or more elements, preferably arranged at or near the interface between the retention element 120 and mating element 210 (when the system is in the mated configuration). The motion arresting elements can be integrated with (e.g., part of, attached to, etc.) the retention element and/or mating element, or can be separate from both elements.

The motion arresting elements can be operable to arrest motion via one or more of a variety of mechanisms. In a first embodiment, the motion is arrested due to friction forces (e.g., between the motion arresting elements and one or more other elements of the system). For example, the motion arresting element can include an elastic element (e.g., gasket, such as an O-ring; one or more dots, ridges, and/or other structures, such as structures protruding from a body in which they are mounted; etc.) compressed between the mated elements. In a first specific example of this embodiment, the elastic element (e.g., element including one or more elastomers, such as silicone) is arranged between and retained against (e.g., compressed between) the mating element (e.g., internal surface of the mating element) and the bridge member. In a second specific example, the elastic element is arranged between and retained against (e.g., compressed between) between the edge of the mating element (e.g., face bounding the inner surface) and one of the flanges (e.g., the shoulder of the flange). However, the motion arresting elements can additionally or alternatively include any other suitable elastic elements in any suitable arrangement.

In a second embodiment, the motion is arrested by mechanical interference between elements of the system. For example, the motion arresting elements can include a key and a keyway (e.g., one on the mating element and the other on the retention element, such as a key on the retention element and a keyway defined in the mating element, or vice versa), wherein the key fits into the keyway in the mated configuration (and motion of the key is restricted due to mechanical interference with the surfaces defining the keyway).

In a third embodiment, the motion arresting elements can arrest motion using magnetic forces, such as wherein the motion arresting elements include complementary magnetic elements (e.g., one on the mating element and the other on the retention element) configured to exert a restoring force on each other, thereby forcing the mated system toward a particular configuration and/or retaining the system in the configuration.

However, the motion arresting elements can additionally or alternatively include any other suitable elements in any other suitable arrangement, operable to arrest motion in any other suitable manner. Further, the system 1 can additionally or alternatively include any other suitable elements in any other suitable arrangement.

Reference is made herein to various geometries and relationships between dimensions that may be defined as being (or not being) substantially equal, substantially parallel, substantially normal, and other analogous terms. A person of skill in the art will recognize that, in this context, "substantially" can be interpreted to mean "within a threshold amount of", wherein, in examples, this threshold amount can be less than 1%, 2%, 5%, 10%, and/or any other suitable value.

Although omitted for conciseness, the preferred embodiments include every combination and permutation of the various system components and the various method processes. Furthermore, various processes of the preferred method can be embodied and/or implemented at least in part as a machine configured to receive a computer-readable medium storing computer-readable instructions. The instructions are preferably executed by computer-executable components preferably integrated with the system. The computer-readable medium can be stored on any suitable computer readable media such as RAMs, ROMs, flash memory, EEPROMs, optical devices (CD or DVD), hard drives, floppy drives, or any suitable device. The computer-executable component is preferably a general or application specific processing subsystem, but any suitable dedicated hardware device or hardware/firmware combination device can additionally or alternatively execute the instructions.

The FIGS. illustrate the architecture, functionality and operation of possible implementations of systems, methods and computer program products according to preferred embodiments, example configurations, and variations thereof. In this regard, each block in the flowchart or block diagrams may represent a module, segment, step, or portion of code, which comprises one or more executable instructions for implementing the specified logical function(s). It should also be noted that, in some alternative implementations, the functions noted in the block can occur out of the order noted in the FIGURES. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

As a person skilled in the art will recognize from the previous detailed description and from the figures and claims, modifications and changes can be made to the preferred embodiments of the invention without departing from the scope of this invention defined in the following claims.

We claim:

1. A system for sexual stimulation, comprising:

an excitation device comprising:

a haptic stimulation unit; and a housing enclosing the haptic stimulation unit, the housing comprising:

a substantially cylindrical bridge member defining a bridge cylinder axis and a bridge diameter, wherein the bridge member comprises a motion arresting element;

a first flange defining a first shoulder abutting the bridge member, the first shoulder defining a first shoulder diameter, wherein the first shoulder is substantially planar and substantially normal to the bridge cylinder axis; and a second flange defining a second shoulder abutting the bridge member, the second shoulder defining a second shoulder diameter, wherein the second shoulder is substantially planar and substantially normal to the bridge cylinder axis;

wherein:

the first shoulder opposes the second shoulder across the bridge member along the bridge cylinder axis;

the first shoulder, the second shoulder, and the bridge member cooperatively define a circumferential groove encircling the bridge member about the bridge cylinder axis; and the housing defines a bridge length along the bridge cylinder axis from the first shoulder to the second shoulder; and an accessory comprising:

a mating element comprising a first face, a second face, and an inner surface extending between the first and second faces, the inner surface defining a substantially cylindrical aperture extending from the first face to the second face along an aperture cylinder axis, the aperture defining:

an aperture length along the aperture cylinder axis, the aperture length substantially equal to the bridge length; and an aperture diameter greater than the bridge diameter, less than the first shoulder diameter, and less than the second shoulder diameter; and a user interface element mechanically connected to the mating element, the user interface element configured to couple the accessory to a user;

wherein the system is operable to repeatably transition between:

an unmated configuration, in which the accessory does not encircle the excitation device; and a mated configuration, in which:

the bridge cylinder axis is substantially colinear with the aperture cylinder axis;

the mating element encircles the bridge member;

the inner surface is retained against the motion arresting element;

the first face substantially contacts the first shoulder; and the second face substantially contacts the second shoulder, wherein the mating element is captive in the groove between the first and second shoulders.

2. A system for sexual stimulation, comprising:

an excitation device comprising:

a haptic stimulation unit; and a housing module enclosing the haptic stimulation unit, the housing module comprising:

a bridge member defining a bridge axis and a maximum bridge width along a direction normal the bridge axis, wherein the bridge member extends along the bridge axis from a first end to a second end, wherein the bridge member comprises a motion arresting element;

a first flange abutting the first end, the first flange defining a first protrusion width from the bridge axis to a first flange extremum; and a second flange abutting the second end, the second flange defining a second protrusion width from the bridge axis to a second flange extremum;

wherein:

the first flange, the second flange, and the bridge member cooperatively define a groove; and the housing module defines a bridge length along the bridge axis from the first flange to the second flange; and an accessory comprising:

a mating element comprising a first face, a second face, and an inner surface extending between the first and second faces, the inner surface defining an aperture extending from the first face to the second face along an aperture axis, the aperture defining a maximum aperture width along a direction normal the aperture axis, wherein:

the maximum aperture width is greater than the maximum bridge width; and a difference between the maximum aperture width and the maximum bridge width is less than the first protrusion width and is less than the second protrusion width; and a user interface element mechanically connected to the mating element, the user interface element configured to couple the accessory to a user;

wherein the system is operable to repeatably transition between:

an unmated configuration, in which the accessory does not encircle the excitation device; and a mated configuration, in which:
the inner surface encircles the bridge member;
the inner surface is retained against the motion arresting element;
the first and second faces are arranged between the first and second flanges; and
the mating element is captive between the first and second flanges.

3. The system of claim 2, wherein the maximum aperture width is substantially equal to the maximum bridge width.

4. The system of claim 3, wherein the maximum aperture width is within 5% of the maximum bridge width.

5. The system of claim 2, wherein the groove encircles the bridge member.

6. The system of claim 2, wherein:
the motion arresting element comprises an elastomer;
the bridge member comprises a substantially rigid material; and
in the mated configuration, the inner surface compresses the elastomer.

7. The system of claim 2, wherein:
the housing module further comprises:
a first housing comprising the first flange; and
a second housing comprising the second flange; and
the first and second housing are removably mechanically coupled via the bridge member.

8. The system of claim 7, wherein:
the first flange defines a first shoulder;
the second flange defines a second shoulder; and
in the mated configuration, the mating element is clamped between the first and second shoulders.

9. The system of claim 7, wherein the mating element is substantially rigid.

10. The system of claim 2, wherein the mating element comprises an elastomer.

11. The system of claim 2, further comprising a second accessory, the second accessory comprising a second mating element and a second user interface element mechanically connected to the second mating element, the second user interface element configured to couple the accessory to the user; wherein the system is operable to repeatably transition between:
the unmated configuration;
the mated configuration; and
a second mated configuration, in which:
the second mating element encircles the bridge member; and
the second mating element is captive between the first and second flanges.

12. The system of claim 11, wherein:
the second mating element is substantially identical to the mating element; and
the second user interface element is substantially different from the user interface element.

13. The system of claim 12, wherein:
the user interface element comprises a first finger ring defining a first ring diameter; and
the second user interface element comprises a second finger ring defining a second ring diameter substantially greater than the first ring diameter.

14. The system of claim 2, wherein the user interface element comprises a finger ring.

15. A system for sexual stimulation, comprising:
an excitation device comprising:
a haptic stimulation unit; and
a housing module enclosing the haptic stimulation unit, the housing module comprising:
a first housing comprising a first flange, the first flange defining a first shoulder;
a second housing comprising a second flange, the second flange defining a second shoulder; and
a power module enclosed within the housing module:
wherein:
the housing module defines a bridge member, the bridge member defining a bridge axis, wherein the bridge member extends along the bridge axis from a first end to a second end;
the first shoulder abuts the first end;
the second shoulder abuts the second end;
the housing module defines a retention volume, wherein the first shoulder, the second shoulder, and the bridge member cooperatively bound the retention volume;
the first and second housing are removably mechanically coupled via the bridge member; and
the housing module defines a bridge length along the bridge axis from the first flange to the second flange; and
an accessory comprising:
a mating element comprising a first face and a second face, the mating element extending along an mating element axis from the first face to the second face, the mating element defining a mating element length along the mating element axis from the first face to the second face, wherein the mating element length is substantially equal to the bridge length, wherein the mating element comprises a conductive material; and
a user interface element mechanically connected to the mating element, the user interface element configured to couple the accessory to a user;
wherein the system is operable to repeatably transition between:
an unmated configuration, in which:
the accessory is not within the retention volume;
the haptic stimulation unit is not operable to provide haptic stimulation; and
the power module is not operable to provide electrical power to the haptic stimulation unit; and
a mated configuration, in which:
the mating element is retained within the retention volume between the first and second shoulders;
the mating element axis is substantially parallel the bridge axis;
the haptic stimulation unit is operable to provide haptic stimulation; and
the power module is operable to provide electrical power to the haptic stimulation unit via the mating element, wherein the system defines an electrical circuit comprising the haptic stimulation unit, the power module, and the mating element.

16. The system of claim 15, wherein:
the bridge member defines a maximum bridge width along a direction normal the bridge axis;
the mating element further comprises an inner surface extending between the first and second faces, the inner surface defining an aperture extending from the first face to the second face along the mating element axis, the aperture defining a maximum aperture width along a direction normal the mating element axis, wherein the maximum aperture width is substantially equal to the maximum bridge width; and in the mated configuration, the inner surface encircles the bridge member.

17. The system of claim 15, wherein:

the conductive material is a metal; and the user interface element comprises a finger ring, the finger ring comprising an elastomer.

18. The system of claim 15, wherein the user interface element comprises a finger ring comprising an elastomer.

19. The system of claim 18, wherein the mating element is substantially rigid.

* * * * *